US011441089B2

(12) United States Patent
Rubin-Pitel et al.

(10) Patent No.: US 11,441,089 B2
(45) Date of Patent: Sep. 13, 2022

(54) HIGH NAPTHENIC CONTENT DISTILLATE FUEL COMPOSITIONS

(71) Applicant: ExxonMobil Technology and Engineering Company, Annandale, NJ (US)

(72) Inventors: Sheryl B. Rubin-Pitel, Newtown, PA (US); Timothy J. Anderson, Chatham, NJ (US); Kenneth C. H. Kar, Yardley, PA (US); Marcia E. Dierolf, Oley, PA (US); Shifang Luo, Annandale, NJ (US); Ian J. Laurenzi, Hampton, NJ (US); Xinrui Yu, Furlong, PA (US); Yi Xu, Millburn, NJ (US)

(73) Assignee: ExxonMobil Technology and Engineering Company, Annandale, NJ (US)

( * ) Notice: Subject to any disclaimer, the term of this patent is extended or adjusted under 35 U.S.C. 154(b) by 0 days.

(21) Appl. No.: 17/325,944

(22) Filed: May 20, 2021

(65) Prior Publication Data

US 2021/0363449 A1 Nov. 25, 2021

Related U.S. Application Data

(60) Provisional application No. 63/028,715, filed on May 22, 2020.

(51) Int. Cl.
*C10L 1/08* (2006.01)
*C10G 45/02* (2006.01)
(Continued)

(52) U.S. Cl.
CPC ..... *C10L 1/08* (2013.01); *C10G 7/00* (2013.01); *C10G 45/02* (2013.01); *C10G 45/44* (2013.01);
(Continued)

(58) Field of Classification Search
CPC ..... C10G 2300/107; C10G 2300/202; C10G 2300/301; C10G 2300/307;
(Continued)

(56) References Cited

U.S. PATENT DOCUMENTS 6,883,020 B1 4/2005 Taranto et al.
10,316,263 B2 6/2019 Rubin-Pitel et al.
(Continued)

FOREIGN PATENT DOCUMENTS

CN 105273745 A * 1/2016
CN 105273745 A 1/2016
EP 1619231 A1 1/2006

OTHER PUBLICATIONS

CN105273745A—Bibliographic data translation (Year: 2016).*
(Continued)

*Primary Examiner* — Ellen M McAvoy
*Assistant Examiner* — Chantel L Graham
(74) *Attorney, Agent, or Firm* — Robert A. Migliorini

(57) ABSTRACT

Distillate boiling range and/or diesel boiling range compositions are provided that are formed from crude oils with unexpected combinations of high naphthenes to aromatics weight and/or volume ratio and a low sulfur content. This unexpected combination of properties is characteristic of crude oils that can be fractionated to form distillate/diesel boiling range compositions that can be used as fuels/fuel blending products with reduced or minimized processing. The resulting distillate boiling range fractions and/or diesel boiling range fractions can have an unexpected combination of a high naphthenes to aromatics weight and/or volume ratio, a low but substantial aromatics content, and a low sulfur content. By reducing, minimizing, or avoiding the amount of hydroprocessing needed to meet fuel and/or fuel blending product specifications, the fractions derived from
(Continued)

the high naphthenes to aromatics ratio and low sulfur crudes can provide fuels and/or fuel blending products having a reduced or minimized carbon intensity.

26 Claims, 16 Drawing Sheets

(51) Int. Cl.

| | |
|---|---|
| ***C10G 45/44*** | (2006.01) |
| ***C10G 7/00*** | (2006.01) |
| ***C10G 67/02*** | (2006.01) |
| ***C10L 1/04*** | (2006.01) |
| ***C10L 1/02*** | (2006.01) |

(52) U.S. Cl.
CPC ..... *C10G 67/02* (2013.01); *C10G 2300/107* (2013.01); *C10G 2300/202* (2013.01); *C10G 2300/301* (2013.01); *C10G 2300/307* (2013.01); *C10G 2300/405* (2013.01); *C10G 2300/4043* (2013.01); *C10G 2400/04* (2013.01); *C10L 2200/0446* (2013.01); *C10L 2200/0469* (2013.01)

(58) Field of Classification Search
CPC ..... C10G 2300/4043; C10G 2300/405; C10G 2400/04; C10G 45/02; C10G 45/44; C10G 65/08; C10G 67/02; C10G 7/00; C10L 1/08; C10L 2200/0446; C10L 2200/0469
See application file for complete search history.

(56) References Cited

U.S. PATENT DOCUMENTS

| | | | | |
|---|---|---|---|---|
| 2012/0246999 | A1 | 10/2012 | Stern et al. | |
| 2016/0265324 | A1* | 9/2016 | Keith | G06Q 50/06 |
| 2017/0144884 | A1* | 5/2017 | Cantat | B01J 31/0285 |
| 2017/0183575 | A1* | 6/2017 | Rubin-Pitel | C10G 21/14 |
| 2018/0371343 | A1 | 12/2018 | Rubin-Pitel et al. | |
| 2019/0093036 | A1 | 3/2019 | Berkhous et al. | |
| 2019/0185772 | A1 | 6/2019 | Berkhous et al. | |

OTHER PUBLICATIONS

CN105273745A—Claims translation (Year: 2016).*
CN105273745A—Description translation (Year: 2016).*
Ohmes et al., "Impact of Light Tight Oils on Distillate Hydrotreater Operation", Petroleum Technology Quarterly, May 2016, pp. 25-33.
Drushel et al., "Spectrophotometric Determination of Aliphatic Sulfides in Crude Petroleum Oils and Their Chromatographic Fractions" (Anal. Chem. 1955, 27, 4, 495-501).
Mondal et al., "Dynamic Approach for the Estimation of Olefins in Cracked Fuel Range Products of Variable Nature and Composition by 1H NMR Spectroscopy" (Energy Fuels 2019, 33, 2, 1114-1122).
Deal et al., "Determination of Basic Nitrogen in Oils" (Anal. Chem. 1953, 25, 3, 426-432).
International Search Report and Written Opinion PCT/US2021/033573 dated Aug. 31, 2021.

* cited by examiner

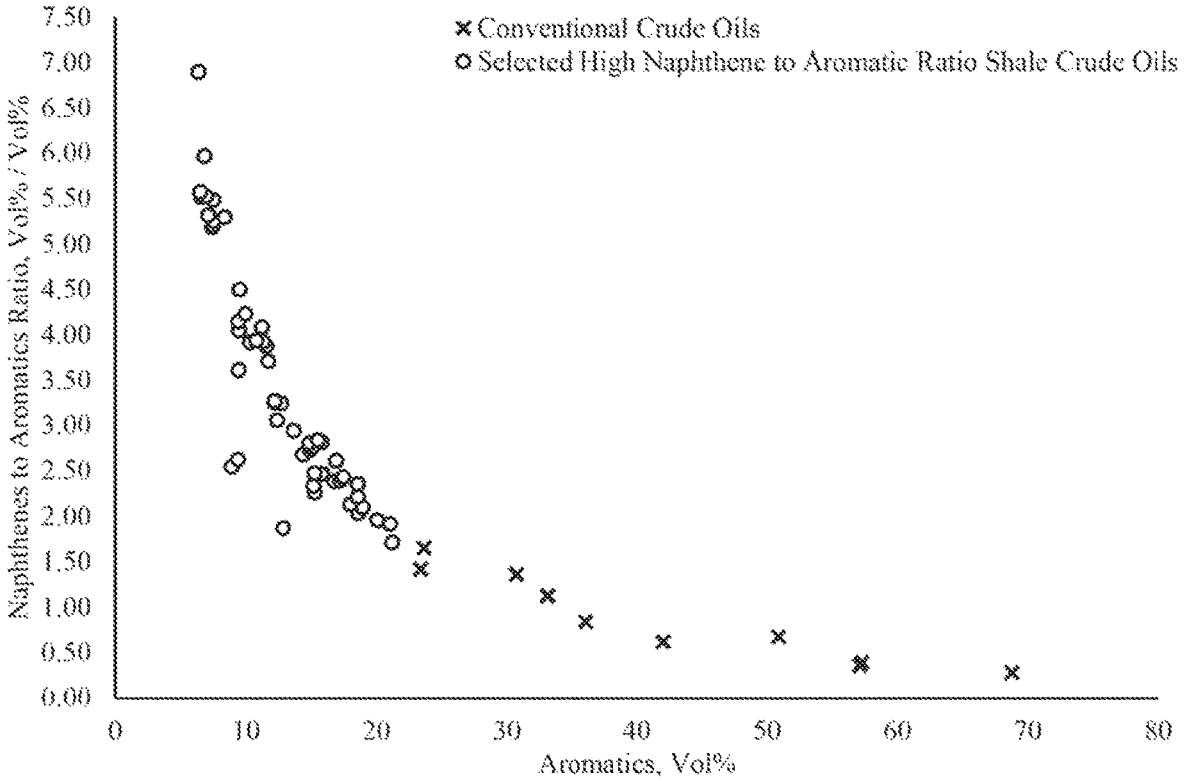
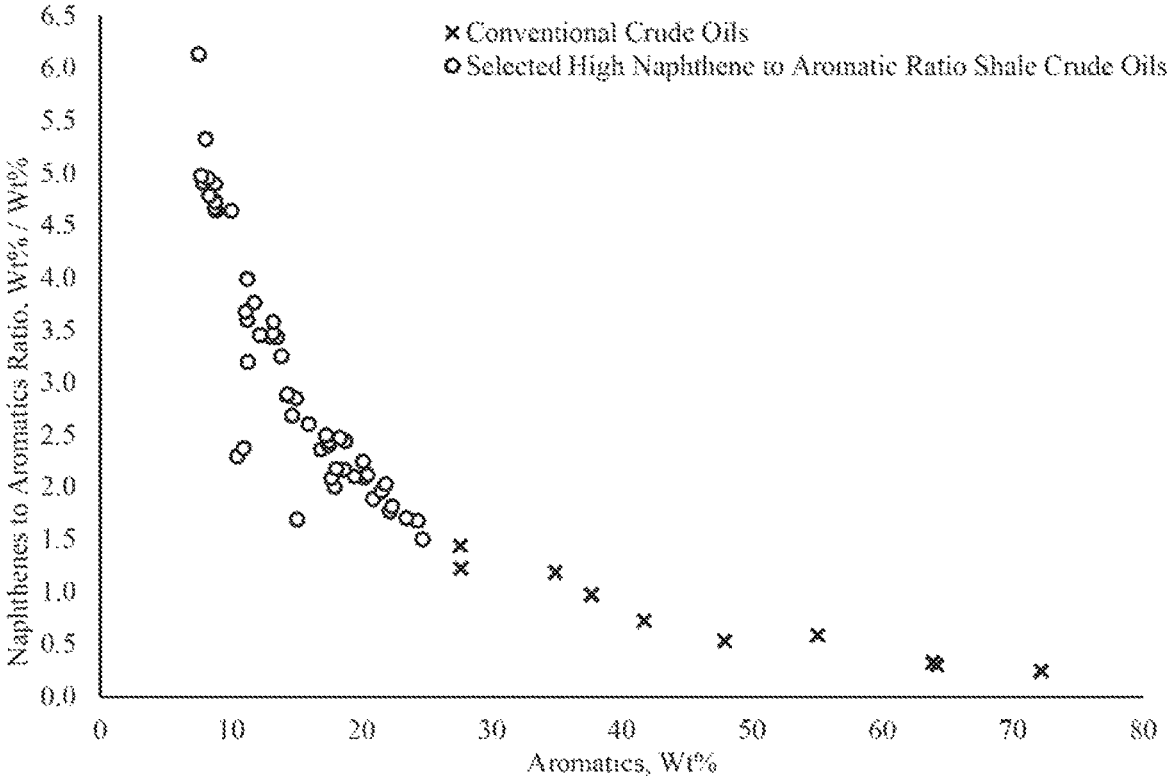
FIG. 1

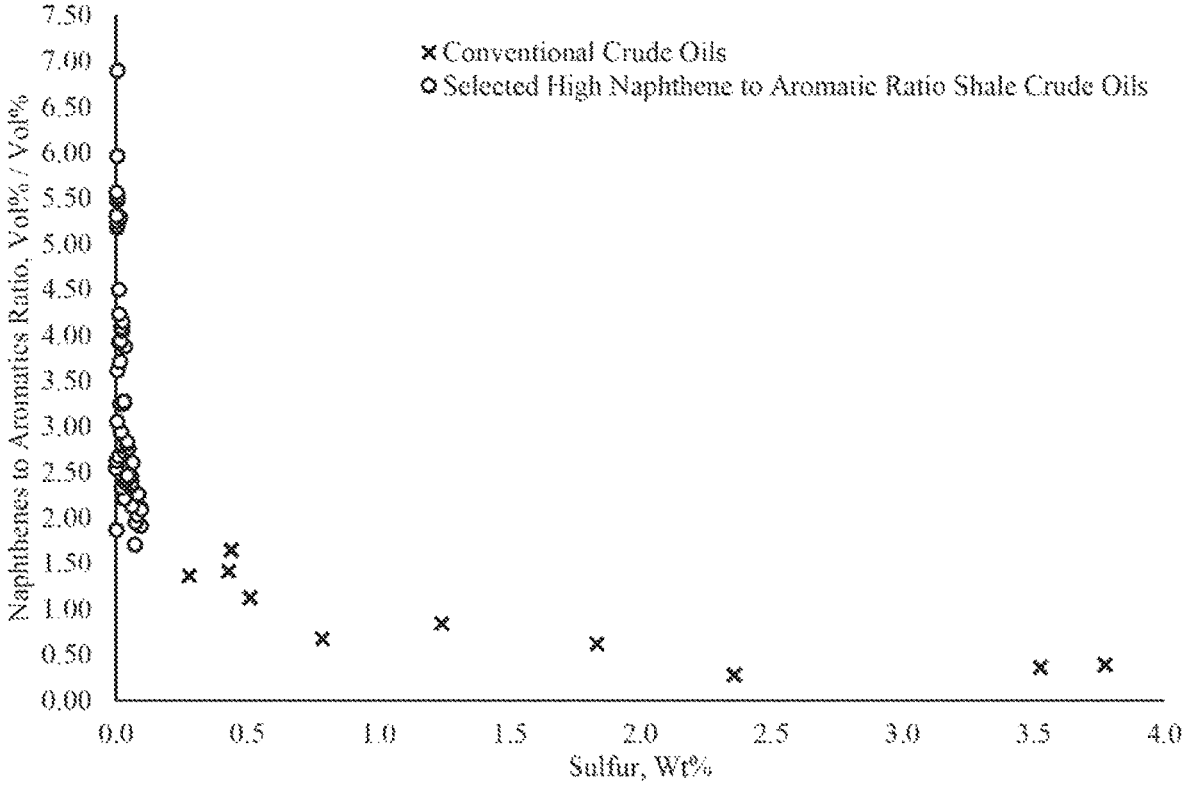
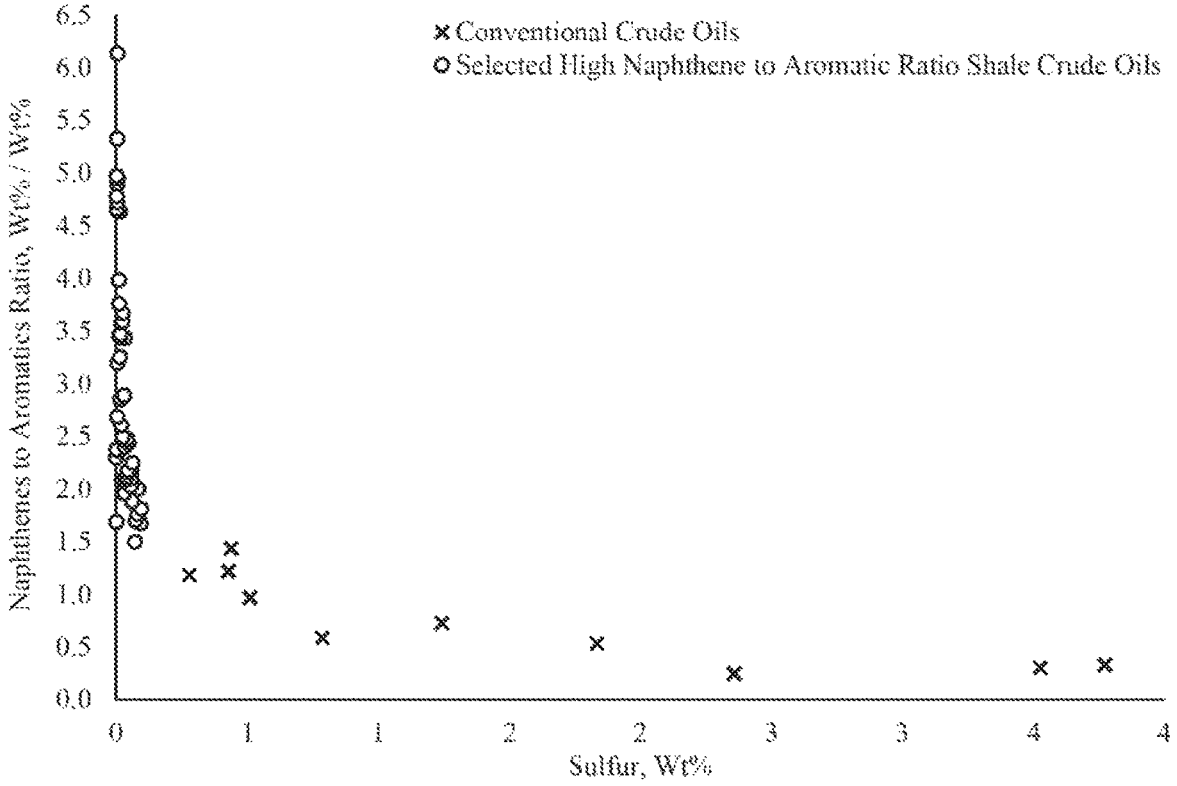
FIG. 2

| Property | | ASTM D975 Diesel No. 2 S15 | ASTM D396 Fuel Oil No. 2 S500 | ISO 8217 DMA ECA Sulfur Level | Selected High Naphthene to Aromatics Ratio Shale Diesels Min - Max | Conventional Diesels Min - Max | ULSD (Meas.) |
|---|---|---|---|---|---|---|---|
| Boiling Point Range | °C | | - | | 166 - 352 | 166 - 352 | - |
| Number of Diesel Samples | | | | | 53 | 9 | 1 |
| Distillation Temperature | | | | | | | |
| 10% Vol Recovered | °C | | | | 185.2 - 204.9 | 201.3 - 237.2 | 215 |
| 90% Vol Recovered | °C | 282 - 338 | 282 - 338 | | 256.6 – 314.5 | 311.5 – 320.8 | 329 |
| KV at 40°C | $mm^2/s$ | 1.9 – 4.1 | 1.9 – 4.1 | 2.000 - 6.000 | 1.7 – 2.4 | 2.3 – 4.5 | - |
| Sulfur, Max | wt% | 0.0015, Max | 0.05, Max | 0.1, Max | 0.00049 - 0.04851 | 0.15077 - 1.70721 | - |
| Density at 15 °C | $kg/m^3$ | - | 876, Max | 890.0, Max | 786 - 831 | 826 - 886 | 846.0 |
| Cetane Index | - | 40, Min | | 40, Min | 49.5 - 60.7 | 35.4 - 51.3 | 49.0 |
| Composition | | | | | | | |
| n-Paraffins | wt% | | | | 14.3 - 34.5 | 0.8 - 16.3 | 18.8* |
| i-Paraffins | wt% | | | | 18.1 - 41.9 | 9.5 - 25.2 | 26.8* |
| Cyclo-Paraffins (Naphthenes) | wt% | | | | 21.7 - 53.4 | 30.7 - 51.8 | 24.8* |
| Aromatics | wt% | 35 vol%, Max | | | 5.9 - 17.6 | 18.2 - 40.4 | 29.5* |
| Saturated Hydrocarbons (n-Paraffins + i-Paraffins + Cyclo-Paraffins) | wt% | | | | 82.4 - 94.1 | 56.8 - 81.4 | 70.4* |
| Cyclic Hydrocarbons (Aromatic + Naphthenes) | wt% | | | | 29.2 - 67.1 | 58.1 - 83.9 | 54.3* |
| Naphthenes to Aromatic Ratio | wt% /wt% | | | | 2.5 – 7.7 | 0.8 - 2.2 | 0.841* |
| Cetane Index to Aromatics Ratio | - | | | | 2.8 – 9.7 | 1.0 – 2.8 | 1.7 |

* Measured ULSD values based on Vol%

FIG. 3

| Boiling Point Range | Unit | 166 – 352 °C | 166 – 352 °C | 166 – 352 °C |
|---|---|---|---|---|
| Property | | Selected High Naphthene to Aromatics Ratio Shale Diesels Min - Max | Other Shale Diesels Min - Max | Conventional Diesels Min - Max |
| Number of Diesel Samples | | 53 | 15 | 9 |
| Distillation Temperature | | – | – | – |
| 10% Vol Recovered | °C | 185.2 – 204.9 | 199.5 – 204.2 | 201.3 – 237.2 |
| 50% Vol Recovered | °C | 202.8 – 252.6 | 241.4 – 252.9 | 244.2 – 286.4 |
| 90% Vol Recovered | °C | 256.6 – 314.5 | 310.6 – 313.8 | 311.5 – 320.8 |
| Density | $g/cm^3$ | 0.786 – 0.831 | 0.808 – 0.844 | 0.826 – 0.886 |
| KV at 40°C | $mm^2/s$ | 1.67 – 2.45 | 2.19 – 2.49 | 2.34 – 4.46 |
| Cetane Index | - | 49.5 – 60.7 | 44.8 – 57.2 | 35.4 – 51.3 |
| Sulfur | wppm | 4.9 – 485.1 | 21.3 – 2943.2 | 1507.7 – 17072.1 |
| Aliphatic Sulfur | wppm | 4.9 – 224.0 | 6.8 – 1441.4 | 527.9 – 8094.2 |
| Aliphatic Sulfur to Sulfur Ratio | wppm / wppm | 0.17 – 1.00 | 0.11 – 1.00 | 0.33 – 0.50 |
| Nitrogen | wppm | 0.7 – 45.9 | 2.8 – 44.5 | 27.9 – 174.4 |
| Basic Nitrogen | Wppm | 0.1 – 20.5 | 0.6 – 19.1 | 12.3 – 69.6 |
| Basic Nitrogen to Nitrogen Ratio | wppm / wppm | 0.1 – 1.0 | 0.19 – 0.49 | 0.39 – 0.64 |
| Aromatics | wt% | 5.9 – 17.6 | 6.4 – 28.1 | 18.2 – 40.4 |
| Paraffins | wt% | 32.8 – 70.8 | 33.5 – 50.7 | 10.3 – 41.5 |
| Naphthenes | wt% | 21.7 – 53.4 | 33.7 – 50.6 | 30.7 – 51.8 |
| Cyclic Hydrocarbons (Aromatic + Naphthenes) | wt% | 29.2 – 67.1 | 49.3 – 66.4 | 58.1 – 83.9 |
| Saturated Hydrocarbons (Paraffins + Naphthenes) | wt% | 82.4 – 94.1 | 71.7 – 93.6 | 56.8 – 81.4 |
| Naphthenes to Aromatics Ratio | wt% / wt% | 2.5 – 7.7 | 1.3 – 6.9 | 0.8 – 2.2 |
| Cetane Index to Aromatics Ratio | - | 2.8 – 9.7 | 1.6 – 8.9 | 1.0 – 2.8 |

FIG. 4

| Boiling Point Range | Unit | 279-371 °C | 279-371 °C | 279-371 °C |
|---|---|---|---|---|
| Property | | Selected High Naphthene to Aromatics Ratio Shale Diesels Min - Max | Other Shale Diesels Min - Max | Conventional Diesels Min - Max |
| Number of Diesel Samples | | 56 | 12 | 9 |
| Distillation Temperature | | - | - | - |
| 10% Vol Recovered | °C | 288.5 – 298.0 | 295.3 – 296.9 | 295.2 – 301.0 |
| 50% Vol Recovered | °C | 296.4 – 316.7 | 313.0 – 315.4 | 312.5 – 322.0 |
| 90% Vol Recovered | °C | 319.7 – 340.8 | 339.9 – 340.8 | 339.5 – 343.2 |
| Density | $g/cm^3$ | 0.821 – 0.858 | 0.845 – 0.871 | 0.857 – 0.918 |
| KV at 40°C | $mm^2/s$ | 3.71 – 6.21 | 4.63 – 6.35 | 5.85 – 11.39 |
| Cetane Index | - | 60.2 – 76.3 | 54.2 – 66.4 | 36.6 – 60.6 |
| Sulfur | wppm | 9.2 – 983.3 | 35.0 – 5345.7 | 3311.6 – 23532.2 |
| Aliphatic Sulfur | wppm | 9.1 – 397.3 | 35.0 – 1864.2 | 938.0 – 9077.1 |
| Aliphatic Sulfur to Sulfur Ratio | wppm / wppm | 0.15 – 1.0 | 0.09 – 1.00 | 0.26 – 0.53 |
| Nitrogen | wppm | 1.4 – 154.5 | 42.1 – 184.7 | 97.6 – 357.2 |
| Basic Nitrogen | wppm | 0.5 – 62.8 | 13.5 – 59.9 | 44.8 – 202.3 |
| Basic Nitrogen to Nitrogen Ratio | wppm / wppm | 0.12 – 1.0 | 0.17 – 0.42 | 0.4 – 0.65 |
| Aromatics | wt% | 4.6 – 19.9 | 13.87 – 28.61 | 23.6 – 42.5 |
| Paraffins | wt% | 27.2 – 63.4 | 27.9 – 42.9 | 7.4 – 33.9 |
| Naphthenes | wt% | 26.4 – 61.2 | 37.2 – 52.4 | 30.2 – 45.9 |
| Cyclic Hydrocarbons (Aromatic + Naphthenes) | wt% | 36.6 – 72.5 | 57.0 – 71.9 | 65.2 – 85.2 |
| Saturated Hydrocarbons (Paraffins + Naphthenes) | wt% | 79.7 – 95.3 | 70.9 – 85.6 | 50.1 – 75.5 |
| Naphthenes to Aromatics Ratio | wt% / wt% | 2.5 – 13.0 | 1.4 – 3.8 | 0.7 – 1.8 |
| Cetane Index to Aromatics Ratio | - | 3.1 – 15.8 | 1.9 – 4.8 | 0.9 – 2.6 |

FIG. 5

| Boiling Point Range | Unit | 232-371 °C | 232-371 °C | 232-371 °C |
|---|---|---|---|---|
| Property | | Crude 78 Straight Run Diesel | Crude 79 Straight Run Diesel | Crude 80 Straight Run Diesel |
| Density at 15.6°C | g/mL | 0.8458 | 0.8325 | 0.8316 |
| D86 Equivalent T10 | °C | 269 | 278 | 277 |
| D86 Equivalent T50 | °C | 293 | 300 | 298 |
| D86 Equivalent T90 | °C | 331 | 341 | 337 |
| Cetane Index | - | 58.50 | 67.60 | 67.50 |
| Hydrogen content | mass% | 13.24 | 13.72 | 13.76 |
| Derived Cetane Number | - | 56.44 | 65.83 | 65.28 |
| Cloud Point | °C | -5 | 0 | -3 |
| Paraffin Content | wt% | 32.78 | 39.15 | 39.53 |
| Naphthene Content | wt% | 41.54 | 45.07 | 45.47 |
| Aromatic Content | wt% | 25.68 | 15.78 | 14.99 |
| Naphthenes / Aromatics Ratio | wt%/wt% | 1.62 | 2.86 | 3.03 |
| Saturates Content (Naphthenes + Paraffins) | wt% | 74.32 | 84.22 | 85.00 |
| Cyclics Content (Naphthenes + Aromatics) | wt% | 67.22 | 60.85 | 60.46 |
| Pour Point | °C | -10 | -5 | -8 |
| Mini Flash Point, Continuous Closed Cup | °C | 113.5 | 116.5 | 115.5 |
| CFPP | °C | -8.00 | -5.00 | -7.00 |
| Kinematic Viscosity at 40°C | cSt | 3.86 | 4.23 | 4.18 |
| Sulfur Content | mg/kg | 456 | 289 | 293 |
| Aliphatic Sulfur Content | mass% | 0.029 | 0.037 | 0.04 |
| Aliphatic Sulfur/Non-Aliphatic Sulfur Ratio | wppm/ wppm | 0.64 | 1.28 | 1.37 |
| Nitrogen Content | wppm | 56.00 | 47.30 | 39.30 |
| Basic Nitrogen Content | wppm | 26 | 24 | 23 |
| Basic Nitrogen/Nitrogen Ratio | wppm/ wppm | 0.46 | 0.51 | 0.59 |
| Cetane Index to Aromatics Ratio | - | 2.3 | 4.3 | 4.5 |
| Derived Cetane Number to Aromatics Ratio | - | 2.2 | 4.2 | 4.4 |

FIG. 6

| Boiling Point Range | °C | | 295-360 | 288-371 | 177-371 | 177-371 | 177-371 |
|---|---|---|---|---|---|---|---|
| | | ASTM D975, No.2 S15 | Diesel 1 *HDT | Diesel 2 *HDT | Diesel 3 *HDT | Diesel 4 *HDT | Diesel 5 *HDT |
| Density at 15.6 °C | g/ml | | 0.8336 | 0.8332 | 0.8186 | 0.8175 | 0.8189 |
| API Gravity | - | | | 38.1 | 41.2 | 41.4 | 41.1 |
| Sulfur Content | mg/kg | Max, 15 | 1.4 | 1.5 | 0.5 | 0.3 | 0.6 |
| Nitrogen Content | mg/kg | | 0.3 | 0.3 | 0.6 | <0.2 | <0.2 |
| Cloud Point | °C | | 6 | 8 | -8 | -4 | -13 |
| Pour Point | °C | | 2 | 2 | -18 | -14 | -23 |
| Freeze Point | °C | | 8 | 8.1 | -5.6 | -3.5 | -10.2 |
| Smoke Point | mm | | 25.3 | | 28.1 | 28.7 | |
| Derived Cetane Number | - | Min, 40 | 68.7 | - | 60.6 | 60.9 | - |
| Cetane Index | - | Min, 40 | 74.7 | 73.8 | 57.8 | 58.1 | 57.4 |
| Net Heat of Combustion | MJ/kg | | 42.9 | 43.0 | 43.1 | 43.1 | - |
| Volumetric Heating Value | MJ/liter | | 35.8 | 35.8 | 35.3 | 35.2 | - |
| GC Distillation | | | | | | | |
| Temperature, 10% off | °C | | 294 | 290 | 194 | 193 | 196 |
| Temperature, 50% off | °C | | 329 | 328 | 267 | 267 | 265 |
| Temperature, 90% off | °C | 282 - 338 | 359 | 371 | 350 | 352 | 347 |
| Composition | | | | | | | |
| Paraffins | wt% | | 43.49 | 43.07 | 40.63 | 40.16 | 41.67 |
| 1-Ring Naphthenes | wt% | | 19.48 | 18.22 | 19.86 | 20.71 | 23.18 |
| 1-Ring Aromatics | wt% | | 14.51 | 14.03 | 12.53 | 11.77 | 18.13 |
| Multi Ring Aromatics | | | 5.37 | 6.71 | 2.68 | 2.71 | 4.59 |
| Total Naphthenes | wt% | | 36.63 | 36.19 | 44.16 | 45.36 | 35.60 |
| Total Aromatics | wt% | Max, 35 | 19.88 | 20.74 | 15.21 | 14.48 | 22.72 |
| Saturated Hydrocarbons (Paraffins + Naphthenes) | wt% | | 80.12 | 79.26 | 84.79 | 85.52 | 77.27 |
| Cyclic Hydrocarbons (Aromatics + Naphthenes) | wt% | | 56.51 | 56.93 | 59.37 | 59.84 | 58.32 |
| Naphthenes to Aromatics Ratio | wt% / wt% | | 1.8 | 1.7 | 2.9 | 3.1 | 1.6 |
| Cetane Index to Aromatics Ratio | - | | 3.8 | 3.6 | 3.8 | 4.0 | 2.5 |
| Derived Cetane Number to Aromatics Ratio | - | | 3.5 | - | 4.0 | 4.2 | - |

*Sample hydrotreated

FIG. 7

| | | ASTM D975, No.2 S15 | EN 590 | | | |
|---|---|---|---|---|---|---|
| Boiling Point Range | °C | | | 288-371 | 177-371 | 177-371 |
| | Units | | | Diesel 2A *HDT and **ASAT | Diesel 3A *HDT and **ASAT | Diesel 4A *HDT and **ASAT |
| Density at 15.6 °C | g/ml | | Max, 0.845 Min, 0.820 | 0.8264 | 0.8127 | 0.8123 |
| API Gravity | - | | | 39.5 | 42.4 | 42.5 |
| Sulfur Content | mg/kg | Max, 15 | Max, 10 | <0.2 | 0.2 | 0.2 |
| Nitrogen Content | mg/kg | | | <0.2 | <0.2 | <0.2 |
| Cloud Point | °C | | | 8 | -7 | -7 |
| Pour Point | °C | | | 2 | | |
| Freeze Point | °C | | | 8.0 | | |
| Smoke Point | mm | | | | 35.6 | 35.4 |
| Derived Cetane Number | - | Min, 40 | Min, 51 | 82.2 | 67.4 | 67.2 |
| Cetane Index | | Min, 40 | Min, 46 | 75.8 | 60.5 | 60.2 |
| Net Heat of Combustion | MJ/kg | | | 43.0 | 43.2 | 43.2 |
| Volumetric Heating Value | MJ/liter | | | 35.5 | 35.1 | 35.1 |
| GC Distillation | | | | | | |
| Temperature, 10% off | °C | | | 284 | 196 | 194 |
| Temperature, 50% off | °C | | | 323 | 267 | 266 |
| Temperature, 90% off | °C | 282 - 338 | 360 (Max, 95%) | 367 | 351 | 352 |
| Composition | | | | | | |
| Paraffins | wt% | | | 45.17 | 42.69 | 42.60 |
| 1-Ring Naphthenes | wt% | | | 29.40 | 28.56 | 28.58 |
| 1-Ring Aromatics | wt% | | | 0.00 | 0.00 | 0.00 |
| Multi Ring Aromatics | | | | 0.00 | 0.00 | 0.00 |
| Total Naphthenes | wt% | | | 54.83 | 57.31 | 57.40 |
| Total Aromatics | wt% | Max, 35 | Max, 8 (Polycyclic) | 0.00 | 0.00 | 0.00 |
| Saturated Hydrocarbons | wt% | | | 100 | 100 | 100 |
| Cyclic Hydrocarbons | wt% | | | 54.83 | 57.31 | 57.4 |
| Naphthenes to Aromatics Ratio | wt%/wt% | | | ∞ | ∞ | ∞ |
| Cetane Index to Aromatics Ratio | - | | | ∞ | ∞ | ∞ |

*Sample hydrotreated

**Sample exposed to aromatic saturation conditions

FIG. 8

| Boiling Point Range | °C | 177-371 | 288-371 | 177-371 | 288-371 |
|---|---|---|---|---|---|
| | Units | Diesel 6 *HDT and **ASAT | Diesel 7 *HDT and **ASAT | Diesel 8 *HDT and **ASAT | Diesel 9 *HDT and **ASAT |
| Density at 15.6 °C | g/ml | 0.79 | 0.81 | 0.79 | 0.81 |
| API Gravity | - | 48.2 | 43.7 | 47.6 | 42.2 |
| Sulfur Content | mg/kg | | 0.2 | <0.2 | 0.2 |
| Nitrogen Content | mg/kg | <0.2 | <0.2 | <0.2 | <0.2 |
| Cloud Point | °C | -9.6 | 5.5 | -9.6 | 3.9 |
| Smoke Point | mm | 25.2 | 27.7 | 24.1 | 24.6 |
| Cetane Index | - | 62.3 | 87.9 | 60.9 | 81.8 |
| GC Distillation | | | | | |
| Temperature, 10% off | °C | 187.9 | 286.7 | 188.7 | 286.0 |
| Temperature, 50% off | °C | 229.7 | 321.9 | 229.8 | 318.1 |
| Temperature, 90% off | °C | 316.4 | 359.9 | 319.3 | 359.7 |
| Composition | | | | | |
| Paraffins | wt% | 65.83 | 80.9 | 65.20 | 70.8 |
| Total Naphthenes | wt% | 27.90 | 12.7 | 24.85 | 19.2 |
| Total Aromatics | wt% | 6.27 | 6.4 | 9.95 | 10.0 |
| Saturated Hydrocarbons | wt% | 93.7 | 93.6 | 90.1 | 90.0 |
| Cyclic Hydrocarbons | wt% | 34.2 | 19.1 | 34.8 | 29.2 |
| Naphthenes to Aromatics Ratio | wt%/wt% | 4.4 | 2.0 | 2.5 | 1.9 |
| Cetane Index to Aromatics Ratio | - | 9.9 | 13.7 | 6.1 | 8.2 |

*Modeled sample exposed to hydrotreating conditions
**Modeled sample exposed to aromatic saturation conditions

FIG. 9

| Properties | Unit | Crude 78 Diesel *HDT | Crude 78 Diesel *HDT + **ASAT | Crude 78 Diesel *HDT + †Cat Dewax + **ASAT | Crude 79 Diesel *HDT + †Cat Dewax + **ASAT |
|---|---|---|---|---|---|
| Distillation Temperature | - | | | | |
| D86 Equivalent T10 | °C | 271 | 274 | 283 | 277 |
| D86 Equivalent T50 | °C | 293 | 292 | 296 | 293 |
| D86 Equivalent T90 | °C | 329 | 329 | 328 | 335 |
| Kinematic Viscosity at 40 °C | cSt | 3.98 | 4.11 | 4.40 | 4.23 |
| Sulfur Content | wppm | 2.9 | 0.4 | 0.5 | <0.2 |
| Nitrogen Content | wppm | <0.2 | <0.2 | <0.2 | <0.2 |
| Density at 15.6 °C | g/mL | 0.8323 | 0.8296 | 0.8316 | 0.8235 |
| Cetane Index (D4737 Proc A) | - | 65.29 | 67.97 | 68.07 | 70.78 |
| Derived Cetane Number | - | 62.25 | 65.51 | 64.11 | 66.80 |
| Cloud Point | °C | -5 | -6 | -13 | -19 |
| Composition | | | | | |
| Paraffins | wt% | 35.82 | 36.24 | 35.90 | 40.50 |
| Naphthenes | wt% | 51.51 | 56.43 | 55.58 | 53.73 |
| Aromatics | wt% | 12.67 | 7.33 | 8.52 | 5.77 |
| Saturated Hydrocarbons | wt% | 87.33 | 92.67 | 91.48 | 94.23 |
| Cyclic Hydrocarbons (Aromatic + Naphthenes) | wt% | 64.18 | 63.76 | 64.1 | 59.5 |
| Naphthene to Aromatics Ratio | wt% / wt% | 4.07 | 7.70 | 6.52 | 9.31 |
| Cetane Index to Aromatics Ratio | - | 5.2 | 9.3 | 8.0 | 12.3 |
| Derived Cetane Number to Aromatics Ratio | - | 4.9 | 8.9 | 7.5 | 11.6 |

*Sample hydrotreated

**Sample exposed to aromatic saturation conditions

†Catalytic dewaxing

FIG. 11

| Property | Unit | Base Diesel | B100 RME | B7 | B20 | HVO | Blend A | Blend B |
|---|---|---|---|---|---|---|---|---|
| Cetane Number | - | 52.5 | 53.7# | 52.6# | 52.7# | 79.2 | 59.7 | 61.2 |
| Cetane Index | - | 55.6 | - | - | - | 93.9 | 62.8 | 62.1 |
| Density at 15°C | g/mL | 0.8342 | 0.8823 | 0.8374 | 0.8434 | 0.780 | - | - |
| Density at 15.6°C | g/mL | - | - | - | - | - | 0.8286 | 0.8338 |
| Flash Point | °C | 88 | - | - | - | 82.0 | 106.7 | 113.3 |
| N-Paraffin Content | wt% | - | - | - | - | 5.11 | 13.52 | 17.88 |
| Isoparaffin Content | wt% | - | - | - | - | 93.30 | 26.8 | 21.49 |
| Total Paraffins Content | wt% | - | - | - | - | 98.40 | 40.32 | 39.37 |
| Total Naphthenes Content | wt% | - | - | - | - | 0.44 | 52.09 | 54.17 |
| Total Aromatics Content | wt% | 30.6 | 0† | 28.3† | 24.2† | 0.07 | 7.6 | 6.46 |
| Multi Ring Aromatics Content | wt% | 1.6 | 0† | 1.5† | 1.3† | 0.00 | 0.33 | 0.28 |
| Saturated Hydrocarbons (Naphthenes + Paraffins) | wt% | - | - | - | - | 98.8 | 92.4 | 93.5 |
| Cyclic Hydrocarbons (Naphthenes + Aromatics) | wt% | - | - | - | - | 0.51 | 59.7 | 60.6 |
| Naphthenes / Aromatics Ratio | wt%/wt% | - | - | - | - | 6.3 | 6.9 | 8.4 |
| Cetane Number to Aromatics Ratio | - | 1.7 | ∞† | 1.9† | 2.2† | 1131 | 7.9 | 9.5 |
| Cetane Index to Aromatics Ratio | - | 1.8# | - | - | - | 1341 | 8.3 | 9.6 |
| Olefin Content | wt% | - | - | - | - | 1.09 | 0 | 0 |
| T10 | °C | 227.5 | - | - | - | 264.7 | 250.7 | 259.2 |
| T50 | °C | 279.1 | - | - | - | 280.2 | 284.3 | 286.6 |
| T90 | °C | 310.9 | - | - | - | 291.5 | 330.2 | 325.8 |
| T95 | °C | 319.1 | - | - | - | 295.0 | 348.7 | 342 |
| Carbon Content | wt% | - | - | - | - | - | 85.87 | 86.1 |
| Hydrogen Content | wt% | - | - | - | - | - | 14.13 | 13.9 |
| Net Heat of Combustion | MJ/kg | 43.1 | 37.5 | 42.7 | 42.0 | 44.1 | 43.6 | 43.5 |
| Volumetric Heating Value | MJ/liter | 36.0 | 33.1 | 35.8 | 35.4 | 34.4 | 36.1 | 36.3 |
| Kinematic Viscosity at 40°C | cSt | 2.82 | 4.51 | < 4.5± | < 4.5± | 2.995 | 4.19 | 4.17 |
| Sulfur Content | wppm | < 3 | < 3 | < 3± | < 3± | < 3 | 0 | 0 |
| FAME Content | Vol% | 0† | 100† | 7† | 20† | < 0.10 | 0† | 0† |
| Ester Content | %(m/m) | - | 97.1 | - | - | - | - | - |

FIG. 12

| | | Tailpipe emissions | | | | Engine out emissions | | |
|---|---|---|---|---|---|---|---|---|
| | Fuel Consumption | CO2 | CO | HC | NOx | CO PR | HC PR | NOx PR |
| Unit | liter/100 km | g/km | mg/km | mg/km | mg/km | mg/km | mg/km | mg/km |
| Fuel | | | | | | | | |
| 1_Base Diesel | 10.06 | 265.3 | 256.27 | 31.03 | 278.8 | 958.1 | 249.73 | 832.83 |
| 2_B7 Diesel | 10.13 | 266.37 | 231.07 | 26.7 | 300.83 | 909.57 | 252.63 | 867 |
| 3_B20 Diesel | 10.14 | 264.78 | 259.16 | 30.33 | 334.89 | 944.64 | 250.31 | 931.53 |
| 4_HVO | 10.51 | 254.53 | 62.43 | 8.03 | 271.6 | 566.93 | 111.2 | 844.23 |
| 5_Blend_A | 9.94 | 258.8 | 135.9 | 16.9 | 271.67 | 809.93 | 178.3 | 738.5 |
| 6_Blend_B | 9.88 | 259.2 | 122.97 | 13.83 | 273.77 | 771.97 | 157.67 | 740.97 |

FIG. 13A

| 5_Blend_A Percent (%) Change versus Comparators± | | Tailpipe emissions | | | | Engine out emissions | | |
|---|---|---|---|---|---|---|---|---|
| Comparator | Fuel Consumption | CO2 | CO | HC | NOx | CO PR | HC PR | NOx PR |
| 1_Base Diesel | 1.2% | 2.5% | 47.0% | 45.5% | 2.6% | 15.5% | 28.6% | 11.3% |
| 2_B7 Diesel | 1.9% | 2.8% | 41.2% | 36.7% | 9.7% | 11.0% | 29.4% | 14.8% |
| 3_B20 Diesel | 2.0% | 2.3% | 47.6% | 44.3% | 18.9% | 14.3% | 28.8% | 20.7% |
| 4_HVO | 5.4% | -1.7% | -117.7% | -110.5% | 0.0% | -42.9% | -60.3% | 12.5% |

±Positive percentage (%) indicates that a result for Blend A is lower than the comparator. Negative (-) percentage indicates that a result for Blend B is higher than the comparator.

FIG. 13B

| 6_Blend_B Percent (%) Change versus Comparators± | | Tailpipe emissions | | | | Engine out emissions | | |
|---|---|---|---|---|---|---|---|---|
| Comparator | Fuel Consumption | CO2 | CO | HC | NOx | CO PR | HC PR | NOx PR |
| 1_Base Diesel | 1.8% | 2.3% | 52.0% | 55.4% | 1.8% | 19.4% | 36.9% | 11.0% |
| 2_B7 Diesel | 2.5% | 2.7% | 46.8% | 48.2% | 9.0% | 15.1% | 37.6% | 14.5% |
| 3_B20 Diesel | 2.6% | 2.1% | 52.6% | 54.4% | 18.3% | 18.3% | 37.0% | 20.5% |
| 4_HVO | 6.0% | -1.8% | -97.0% | -72.2% | -0.8% | -36.2% | -41.8% | 12.2% |

±Positive percentage (%) indicates that a result for Blend A is lower than the comparator. Negative (-) percentage indicates that a result for Blend B is higher than the comparator

FIG. 13C

HIGH NAPTHENIC CONTENT DISTILLATE FUEL COMPOSITIONS

CROSS-REFERENCE TO RELATED APPLICATIONS

This application claims the benefit of U.S. Provisional Application No. 63/028,715 filed on May 22, 2020, the entire contents of which are incorporated herein by reference.

FIELD

This disclosure relates to diesel or distillate boiling compositions having high naphthenic content and low aromatic content, fuel compositions or fuel blending compositions made from diesel or distillate boiling range compositions, and methods for forming such fuel compositions.

BACKGROUND

Historically distillate fuels have been produced from the processing and upgrading of traditional crude oils. These crudes can range quite substantially in composition and properties, but generally all have compositional similarities—i.e. they contain a broad range of compositional constituents (paraffins, isoparaffins, naphthenes, aromatics) and contain percent levels of sulfur, asphaltenes and other residual materials. These crudes require a significant amount of processing/upgrading in order to convert into the optimal fuel product distributions. Common refinery processes necessary to update these crude feedstocks may include: distillation, hydrotreatment, cracking (hydrocracking, FCC, visbreaking, coking, etc.), and alkylation. Depending on the quality of the initial crude feedstock, the degree of processing and the associated qualities of the products can vary substantially. Not only can this result in variations of the final compositions and qualities of the fuels, but also in the amount of resources required to convert the crude feedstocks into the various fuel products.

The amount of resources required for processing of initial crude feedstocks to form distillate fuels can substantially increase the carbon intensity of the resulting distillate fuels. It would be desirable to develop compositions and corresponding methods of making compositions that can produce diesel and/or distillate fuels with reduced or minimized carbon intensities.

An article titled "Impact of Light Tight Oils on Distillate Hydrotreater Operation" in the May 2016 issue of Petroleum Technology Quarterly describes hydroprocessing of kerosene and diesel boiling range fractions derived from tight oils.

U.S. Patent Application Publication 2017/0183575 describes fuel compositions formed during hydroprocessing of deasphalted oils for lubricant production.

U.S. Pat. No. 6,883,020 describes a catalytic processing for opening of naphthene rings.

A journal article by Drushel and Miller titled "Spectrophotometric Determination of Aliphatic Sulfides in Crude Petroleum Oils and Their Chromatographic Fractions" (Anal. Chem. 1955, 27, 4, 495-501) describes methods for determining the quantity of aliphatic sulfur in a hydrocarbon fraction.

A journal article by Kapur et al. titled "Dynamic Approach for the Estimation of Olefins in Cracked Fuel Range Products of Variable Nature and Composition by $^1$H NMR Spectroscopy" (Energy Fuels 2019, 33, 2, 1114-1122) describes a method for determining olefin contents.

A journal article by White et al. titled "Determination of Basic Nitrogen in Oils" (Anal. Chem. 1953, 25, 3, 426-432) describes determining the basic nitrogen content in a hydrocarbon sample.

SUMMARY

In some aspects, a distillate boiling range composition is provided. The distillate boiling range composition includes a T90 distillation point of 360° C. or less, a cetane index of 45 or more, a naphthenes to aromatics weight ratio of 2.5 or more, an aromatics content of 4.5 wt % to 25 wt %, a sulfur content of 1000 wppm or less, and/or a weight ratio of aliphatic sulfur to total sulfur of 0.15 or more. Optionally, the distillate boiling range composition further includes a sulfur content of 500 wppm or less, density at 15.6° C. of 870 kg/m$^3$ or less, saturates content of 78 wt % or more, a weight ratio of basic nitrogen to total nitrogen of 0.15 or more cetane index of 55 or more, or a combination thereof. In some additional aspects, a method for forming such a distillate boiling range composition is provided. The method includes fractionating a crude oil comprising a final boiling point of 600° C. or more to form at least a distillate boiling range fraction, the crude oil comprising a naphthenes to aromatics volume ratio of 1.6 or more and a sulfur content of 0.2 wt % or less, the distillate boiling range composition optionally comprising a carbon intensity of 88 g $CO_2$eq/MJ of lower heating value or less. Optionally, the distillate boiling range composition can include a ratio of cetane index to weight percent of aromatics of 2.8 or higher.

In some aspects, a diesel boiling range composition is provided. The diesel boiling range composition includes a T90 distillation point of 375° C. or less, a naphthenes to aromatics weight ratio of 2.5 or more, an aromatics content of 4.5 wt % to 18 wt %, a cetane index of 55 or more, and/or a sulfur content of 10 wppm or less. In some optional aspects, the aromatics content can be 4.5 wt % to 10 wt %, the naphthenes to aromatics weight ratio can be 4.0 or more, the cetane index can be 57 or more, and/or a naphthenes content of 40 wt % or more. In some optional aspects, the aromatics content can be 4.5 wt % to 10 wt %, the naphthenes to aromatics weight ratio can be 2.4 or more, the naphthenes content can be 20 wt % to 35 wt %, and the cetane index can be 57 or more.

In some aspects, a diesel boiling range composition is provided. The diesel boiling range composition can include a T10 distillation point of 250° C. or more, a T90 distillation point of 375° C. or less, a naphthenes to aromatics weight ratio of 1.6 or more, an aromatics content of 4.5 wt % to 25 wt %, a cetane index of 55 or more, and/or a sulfur content of 10 wppm or less. In some optional aspects, the aromatics content can be 4.5 wt % to 10 wt %, the naphthenes to aromatics weight ratio can be 4.0 or more, and/or the cetane index can be 65 or more. In some optional aspects, the aromatics content can be 4.5 wt % to 10 wt %, the naphthenes to aromatics weight ratio can be 1.8 to 2.5, and the cetane index can be 80 or more.

In some aspects, such distillate boiling range compositions or diesel boiling range compositions can be used as a fuel in an engine, a furnace, a burner, a combustion device, or a combination thereof.

In some aspects, a method for forming a diesel boiling range composition is provided. The method includes fractionating a crude oil comprising a final boiling point of 550° C. or more to form at least a diesel boiling range fraction, the crude oil comprising a naphthenes to aromatics volume ratio of 1.6 or more and a sulfur content of 0.2 wt % or less, the diesel boiling range fraction optionally including a T90 distillation point of 375° C. or less and a sulfur content of 40 wppm to 500 wppm prior to the hydrotreating. Additionally, the method includes hydrotreating the diesel boiling range fraction to form a hydrotreated diesel boiling range fraction including a naphthenes to aromatics weight ratio of 2.5 or more, an aromatics content of 4.5 wt % to 18 wt %, a cetane index of 55 or more, and a sulfur content of 10 wppm or less, the diesel boiling range fraction including a sulfur content of 40 wppm to 500 wppm prior to the hydrotreating, the diesel boiling range fraction optionally being hydrotreated prior to the fractionating. Optionally, the hydrotreated diesel boiling range fraction includes a carbon intensity of 90 g $CO_2$eq/MJ of lower heating value or less. Optionally, the method further includes exposing the hydrotreated diesel boiling range fraction to aromatic saturation conditions to form an aromatic saturated, hydrotreated diesel boiling range fraction.

BRIEF DESCRIPTION OF THE DRAWINGS

FIG. 1 shows compositional information for various crude oils.

FIG. 2 shows compositional information for various crude oils.

FIG. 3 shows modeled composition and property information for distillate fractions from selected high naphthene to aromatics ratio shale crude oils, modeled composition and property information for distillate fractions from conventional crude oils, and measured composition and properties information for a ULSD sample.

FIG. 4 shows modeled composition and property information for distillate fractions from selected high naphthene to aromatics ratio shale crude oils, distillate fractions from other shale crude oils, and distillate fractions from conventional crude oils.

FIG. 5 shows modeled composition and property information for distillate fractions from selected high naphthene to aromatics ratio shale crude oils, distillate fractions from other shale crude oils, and distillate fractions from conventional crude oils.

FIG. 6 shows measured composition and property information for distillate fractions from selected high naphthene to aromatics ratio shale crude oils.

FIG. 7 shows measured composition and property information for distillate fractions from selected high naphthene to aromatics ratio shale crude oils subjected to hydroprocessing conditions.

FIG. 8 shows measured composition and property information for distillate fractions from selected high naphthene to aromatics ratio shale crude oils subjected to hydroprocessing conditions and aromatic saturation conditions.

FIG. 9 shows modeled composition and property information for distillate fractions from selected high naphthene to aromatics ratio shale crude oils subjected to hydroprocessing conditions and aromatic saturation conditions.

FIG. 11 shows measured composition and property information for distillate fractions from selected high naphthene to aromatics ratio shale crude oils subjected to various processing conditions.

FIG. 12 shows measured and calculated composition and property information for various fuels used in vehicle testing on a chassis dynamometer.

FIGS. 13A, 13B, and 13C show measured average fuel economy and emissions results from testing various diesel fuels in a vehicle driving on a chassis dynamometer and calculations of the percent changes in average fuel economy and emissions for two diesel blends with high naphthenic content and low aromatics content compared to conventional petroleum diesel, hydrotreated vegetable oil ("HVO"), and blends of conventional petroleum diesel and biodiesel.

DETAILED DESCRIPTION

Figure 10:
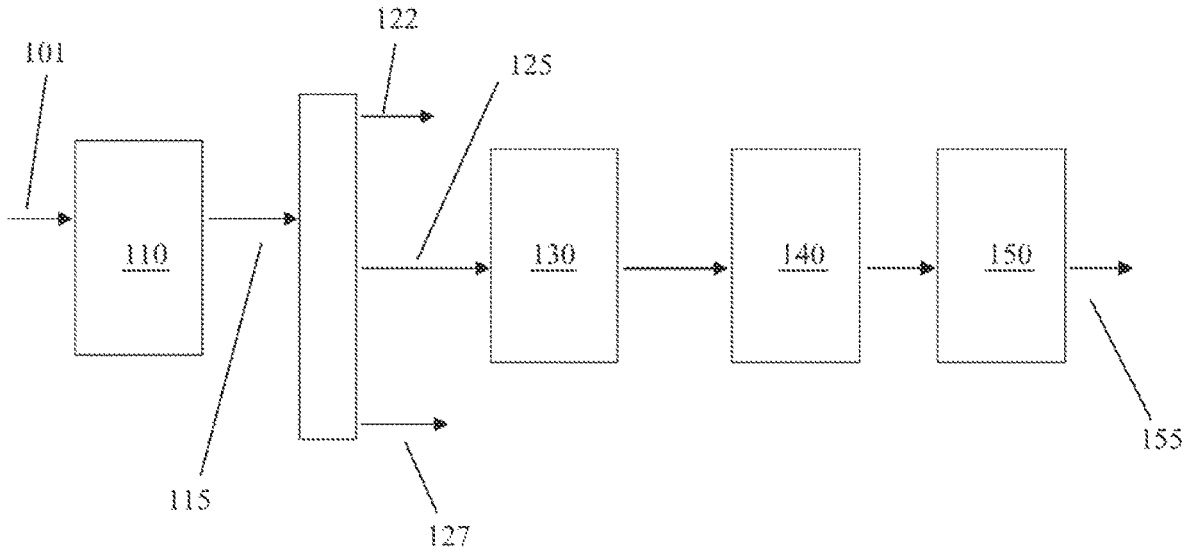
FIG. 10 shows an example of a process configuration for producing a diesel boiling range fraction.

In various aspects, distillate boiling range and/or diesel boiling range compositions are provided that are formed from crude oils with unexpected combinations of high naphthenes to aromatics weight and/or volume ratio and a low sulfur content. This unexpected combination of properties is characteristic of crude oils that can be fractionated to form distillate/diesel boiling range compositions that can be used as fuels/fuel blending products with reduced or minimized processing. The resulting distillate boiling range fractions and/or diesel boiling range fractions can have an unexpected combination of a high naphthenes to aromatics weight and/or volume ratio, a low but substantial aromatics content, and a low sulfur content. In some aspects, the fractions can be used as fuels and/or fuel blending products after fractionation with a reduced or minimized amount of further refinery processing. For example, in some aspects, the fractions can be used as fuels and/or fuel blending products without exposing the fractions to hydroprocessing and/or other energy intensive refinery processes. In other aspects, the amount of additional refinery processing, such as hydrotreatment or aromatic saturation, can be reduced or minimized. By reducing, minimizing, or avoiding the amount of hydroprocessing needed to meet fuel and/or fuel blending product specifications, the fractions derived from the high naphthenes to aromatics ratio and low sulfur crudes can provide fuels and/or fuel blending products having a reduced or minimized carbon intensity. In other words, due to this reduced or minimized processing, the net amount of $CO_2$ generation that is required to produce a fuel or fuel blending component and then use the resulting fuel can be reduced. The reduction in carbon intensity can be on the order of 1%-10% of the total carbon intensity for the fuel. This is an unexpected benefit, given the difficulty in achieving even small improvements in carbon intensity for conventional fuels and/or fuel blending products.

In various aspects, for fuels and/or fuel blending components formed from a distillate fraction having a high naphthenes to aromatics ratio and a low but substantial aromatics content, other unexpected improvements in fuel quality can also be realized. In some aspects, such a fuel and/or fuel blending component can have an unexpected ratio of cetane index to weight percent of aromatics in the fuel and/or fuel blending component. In particular, the ratio of cetane index to the weight percent of aromatics can be unexpectedly high relative to distillate fractions that include a majority of mineral distillate content, while also being substantially below the ratio of cetane index to weight percent of aromatics for distillate fractions composed substantially of bio-derived fractions, such as hydrotreated vegetable oils. It is noted that addition of cetane improvers does not substantially impact the cetane index value, as cetane index is calculated based on distillation values and density for a given sample. Thus, a ratio of cetane index versus weight percent of aromatics represents a value that is based on the overall compositional nature of a fuel fraction. Additionally or alternately, a fuel and/or fuel blending component having a high naphthenes to aromatics ratio while also having a low but substantial aromatics content can have an unexpectedly high volumetric energy density. Without being bound by any particular theory, it is believed that the presence of a low but substantial amount of aromatics contributes to maintaining an unexpectedly high volumetric energy density. The unexpectedly high volumetric energy density is particularly notable relative to highly paraffinic bio-derived distillate fractions, such as hydrotreated vegetable oils. While hydrotreated vegetable oils can have relatively low carbon intensities, such highly paraffinic bio-derived fractions can also have substantially lower volumetric energy densities in comparison with fuels or fuel blending products that have a high naphthenes to aromatics ratio and a low but substantial content of aromatics. Further additionally or alternately, fuels and/or fuel blending components having a high naphthenes to aromatics ratio and a low but substantial aromatics content can have unexpectedly low fuel consumption per distance traveled. Based on dimensional analysis, fuel consumption corresponds to the inverse of fuel mileage (such as miles per gallon). Thus, a low fuel consumption corresponds to improved fuel mileage.

For a straight run diesel or distillate fraction, or for a fraction exposed to only mild hydrotreating, having a high naphthenes to aromatics ratio while still having a low but substantial aromatics content is unexpected due to the ring structures present in both naphthenes and aromatics. Conventionally, it would be expected that a crude fraction including a high ratio of naphthenes to aromatics would correspond to a) a severely hydrotreated composition, so that the high ratio of naphthenes was achieved by converting aromatic rings to saturated rings, b) a composition with a de minimis content of aromatics, or c) a combination of a) and b). Unfortunately, using higher severity hydroprocessing to arrive at a high ratio of naphthenes to aromatics results in increased carbon intensity for a fuel fraction.

With regard to aromatics content, lower aromatics content is generally beneficial for a distillate boiling range fraction or diesel boiling range fraction for a variety of reasons. For example, a lower aromatics content can reduce soot and/or smoke production during combustion. However, an aromatics content that is too close to 0 wt % (such as less than 4.5 wt %, or less than 5.0 wt %) can present difficulties. For example, the presence of at least some aromatics within a diesel and/or distillate boiling range fraction can assist with elastomer shrinkage in diesel fuel systems. Additionally, a low but substantial content of aromatics can also assist with maintaining solvency of polar compounds. Such polar compounds can be introduced into a distillate boiling range composition, for example, in the form of polar compounds contained in a biodiesel fraction and/or as polar compounds that are part of an additive that is used in formulating a diesel fuel. Thus, the unexpected combination of a high naphthenes to aromatics ratio while having a low but substantial aromatics content is beneficial for forming at least some types of fuels from a diesel and/or distillate boiling range fraction. Still further additionally, because of the initial low sulfur content and high naphthenes to aromatics ratio of the distillate boiling range fractions described herein, lower severity hydrotreatment and aromatic saturation can be used to generate a low sulfur diesel fuel with a desirable cetane rating while still providing a reduced carbon intensity.

Generally, the naphthenes to aromatics weight ratio in the distillate boiling range fraction or diesel boiling range fraction, prior to hydrotreating, can be 2.5 or more, or 2.6 or more, or 2.7 or more, or 3.0 or more, or 3.5 or more, or 4.0 or more, or 5.0 or more, or 6.0 or more, or 8.0 or more, or 10.0 or more, such as up to 20, or possibly still higher. However, it is noted that, in various aspects, the high naphthenes to aromatics ratio is not due to an excessively low content of aromatics. Instead, the distillate/diesel boiling range compositions, prior to hydrotreating, have unexpected combinations of high naphthenes to aromatics ratio while still including a minimum aromatics content. For example, the distillate boiling range (or diesel boiling range) compositions can include 4.5 wt % to 25 wt % of aromatics, or 4.5 wt % to 18 wt % of aromatics, or 4.5 wt % to 15 wt %, or 4.5 wt % to 12 wt %, or 4.5 wt % to 10 wt %, or 4.5 wt % to 8 wt %, or 5.0 wt % to 25 wt %, or 5.0 wt % to 18 wt %, or 5.0 wt % to 15 wt %, or 5.0 wt % to 12 wt %. Thus, in some aspects the compositions can include a naphthenes to aromatics weight ratio of 3.0 or more (or 3.5 or more) while having an aromatics content of 4.5 wt % to 18 wt %, 4.5 wt % to 15 wt %, or 4.5 wt % to 12 wt %, or 5.0 wt % to 18 wt %, or 5.0 wt % to 15 wt %, or 5.0 wt % to 12 wt %. Further, in some aspects the distillate boiling range compositions can have an unexpectedly high content of saturates, such as a saturates content of 78 wt % or more, or 81 wt %, or 84 wt % or more, or 87 wt % or more, or 90 wt % or more, such as up to a saturates content of 96 wt %, or up to 95 wt %. Additionally, the sulfur content of the diesel/distillate boiling range composition, prior to hydrotreating, can be 1000 wppm or less, or 500 wppm or less, or 300 wppm or less, or 250 wppm or less, or 100 wppm or less, or 50 wppm or less, such as down to 5 wppm or possibly still lower. In some aspects the sulfur content of the diesel/distillate boiling range composition, prior to hydrotreating, can be 1000 wppm to 5 wppm, or 1000 wppm to 50 wppm, or 1000 wppm to 100 wppm, or 1000 wppm to 200 wppm, or 500 wppm to 5 wppm, or 500 wppm to 50 wppm, or 500 wppm to 100 wppm, or 500 wppm to 200 wppm, or 300 wppm to 5 wppm, or 300 wppm to 20 wppm, or 300 wppm to 50 wppm, or 300 wppm to 80 wppm, or 300 wppm to 100 ppm, or 300 wppm to 200 wppm, or 250 wppm to 10 wppm, or 250 wppm to 50 wppm. Still further additionally, the nitrogen content of the diesel/distillate boiling range composition, prior to hydrotreating, can be 200 wppm or less, or 150 wppm or less, or 100 wppm or less, or 50 wppm or less, such as down to 1 wppm or possibly still lower.

Such a distillate boiling range composition having a high naphthenes to aromatics ratio, a high saturates content, a low sulfur content, and a low but substantial aromatics content can be used, for example, as a distillate heating fuel. In various aspects, a distillate heating fuel (or other distillate fuel) formed at least in part from a distillate boiling range composition with reduced or minimized refinery processing can have a carbon intensity from 1% to 10% lower (or possibly more) relative to a distillate fuel that was hydroprocessed. An example of reduced or minimized refinery processing can include not exposing the distillate boiling range composition to hydroprocessing conditions. A conventional distillate fuel exposed to conventional refinery processing can have, for example, a carbon intensity of 92 g $CO_2$eq/MJ of lower heating value. By reducing or minimizing refinery processing, a distillate fuel can be formed with a carbon intensity of 90 g $CO_2$eq/MJ of lower heating value or less, or 88 g $CO_2$eq/MJ of lower heating value or less, or 86 g $CO_2$eq/MJ of lower heating value or less, such as down to 82 g $CO_2$eq/MJ of lower heating value or possibly still lower.

One indicator of a fuel having a reduced carbon intensity can be an unexpectedly high ratio of aliphatic sulfur to total sulfur. In aspects where a distillate/diesel fraction is not hydrotreated, the distillate/diesel fraction can also have an unexpectedly high ratio of aliphatic sulfur to total sulfur. Aliphatic sulfur is typically removed easily from distillate fractions under hydrotreatment conditions, so a distillate fraction that has a sulfur content of 1000 wppm or less due to hydrotreatment can typically have a weight ratio of aliphatic sulfur to total sulfur of less than 0.15. In other words, aliphatic sulfur corresponds to less than 15 wt % of the total sulfur. By contrast, a distillate fraction that has not been exposed to hydrotreating conditions can have a weight ratio of aliphatic sulfur to total sulfur of 0.15 or more, or 0.2 or more, or 0.3 or more, such as up to 0.8 or possibly still higher.

Still another indicator of a low carbon intensity fuel can be an elevated ratio of basic nitrogen to total nitrogen in a fuel or fuel blending product. Basic nitrogen in distillate fractions is typically easier to remove by hydrotreatment. The presence of an increased amount of basic nitrogen in a product can therefore indicate a lack of hydroprocessing for the product. For example, a weight ratio of basic nitrogen to total nitrogen of 0.15 or more (or 0.2 or more, or 0.3 or more, such as up to 0.8 or possibly still higher) can indicate a product that has not been exposed to hydroprocessing conditions, while a weight ratio of basic nitrogen to total nitrogen of less than 0.15, or less than 0.1, can indicate a product that has been hydroprocessed.

In some aspects, another indicator of a fraction that has not been hydroprocessed is that a distillate fraction has a ratio of n-paraffins to total paraffins (n-paraffins plus isoparaffins) of 0.4 or more. A high ratio of n-paraffins to total paraffins can indicate a fraction that has not been exposed to dewaxing conditions.

Another property of a distillate boiling range composition can include a density at 15.6° C. of 870 kg/m$^3$ or less, or 860 kg/m$^3$, or less or 850 kg/m$^3$ or less, or 830 kg/m$^3$ or less, such as down to 780 kg/m$^3$ or possibly still lower. In some aspects, a distillate boiling range composition can include a density at 15.6° C. of 870 kg/m$^3$ to 780 kg/m$^3$, or 870 kg/m$^3$ to 800 kg/m$^3$, or 870 kg/m$^3$ to 820 kg/m$^3$, or 860 kg/m$^3$ to 780 kg/m$^3$, or 830 kg/m$^3$ to 780 kg/m$^3$. In other aspects, a distillate boiling range composition can include a kinematic viscosity at 40° C. of 6.5 cSt or less, or 4.5 cSt or less, or 3.5 cSt or less, or 2.5 cSt or less, or 2.3 cSt or less, such as down to 1.5 cSt or possibly still lower. In still other aspects, a distillate boiling range composition can include a T90 distillation point of 360° C. or less, or 350° C. or less, or 340° C. or less, or 330° C. or less, or 320° C. or less, such as down to 280° C. or possibly still lower; a cetane index of 45 or more, or 49 or more, or 55 or more, or 65 or more, or 70 or more, such as up to 80 or possibly still higher; a cetane number of 45 or more, or 49 or more, or 55 or more, or 65 or more, or 70 or more, such as up to 80 or possibly still higher; a ratio of cetane index to weight percent aromatics of 2.0 or higher, or 2.3 or higher, or 2.5 or higher, or 2.8 or higher, or 3.0 or higher, or 4.0 or higher, or 6.0 or higher, such as up to 25 or possibly still higher; a ratio of cetane number to weight percent aromatics of 2.0 or higher, or 2.3 or higher, or 2.5 or higher, or 3.0 or higher, or 4.0 or higher, or 6.0 or higher, such as up to 25 or possibly still higher; and/or a pour point of 5° C. to −30° C.

In aspects where some low severity hydrotreating is performed, the resulting hydrotreated fractions can have a high naphthenes to aromatics weight ratio while still retaining a low but substantial aromatics content and a high saturates content. It is noted that the hydrotreating can be performed prior to and/or after fractionation to form a diesel boiling range fraction or a distillate boiling range fraction. In such aspects, the mildly hydrotreated distillate/diesel boiling range fraction can have an aromatics content of 4.5 wt % to 25 wt %, or 10 wt % to 25 wt %, or 12 wt % to 25 wt %, a naphthenes to aromatics weight ratio of 1.6 or more, or 2.5 or more, or 2.6 or more, or 2.9 or more, or 4.0 or more, or 6.0 or more, such as up to 8.0 or possibly still higher, while having a saturates content of 80 wt % or more, or 82 wt % or more, or 85 wt % or more, or 90 wt % or more, such as up to 95 wt %. The hydrotreating can be used to reduce the sulfur to 20 wppm or less, or 10 wppm or less, or 5.0 wppm or less, 1.0 wppm or less, or 0.1 wppm or less, such as down to 0.05 wppm or possibly still lower. Due to the low initial sulfur level in the distillate/diesel boiling range fractions prior to hydrotreating, the severity of hydrotreating used to reduce the sulfur level to 20 wppm or less (or 10 wppm or less) is relatively low, so that a carbon intensity advantage can still be realized relative to a diesel/distillate fuel formed from a conventional crude.

Such a mildly hydrotreated distillate/diesel boiling range composition having a high naphthenes to aromatics ratio, a high saturates content, and a low but substantial aromatics content can be used, for example, as a diesel fuel with a sulfur content of 10 wppm or less. In various aspects, a diesel fuel (or other diesel/distillate boiling range fuel) formed at least in part from a diesel/distillate boiling range composition with reduced or minimized refinery processing can have a carbon intensity from 1% to 10% lower (or possibly more) relative to a conventional diesel fuel that with a sulfur content of 10 wppm or less. A conventional diesel fuel with a sulfur content of 10 wppm or less can have, for example, a carbon intensity of 92 g $CO_2$eq/MJ of lower heating value. By contrast, the mildly hydrotreated diesel fuels described herein can be formed with a carbon intensity of 90 g $CO_2$eq/MJ of lower heating value or less, or 88 g $CO_2$eq/MJ of lower heating value or less, or 86 g $CO_2$eq/MJ of lower heating value or less, such as down to 84 g $CO_2$eq/MJ of lower heating value or possibly still lower.

Still other properties of a hydrotreated diesel boiling range composition can include a density at 15° C. of 810 kg/m$^3$ to 835 kg/m$^3$, or 820 kg/m$^3$ to 835 kg/m$^3$; a T90 distillation point of 375° C. or less, or 360° C. or less, or 320° C. or less, such as down to 280° C., or possibly still lower; a cetane index of 55 or more, or 65 or more, or 70 or more, such as up to 80 or possibly still higher; a cetane number of 55 or more, or 65 or more, or 70 or more, such as up to 80 or possibly still higher; a ratio of cetane index to weight percent of aromatics of 2.5 or higher, or 2.8 or higher, or 3.0 or higher, or 4.0 or higher, or 6.0 or higher, or 8.0 or higher, or 10.0 or higher, or 13.0 or higher, such as up to 25 or possibly still higher; a ratio of cetane number to weight percent aromatics of 2.5 or higher, or 3.0 or higher, or 4.0 or higher, or 6.0 or higher, or 8.0 or higher, or 10.0 or higher, or 13.0 or higher, such as up to 25 or possibly still higher; and/or a pour point of 5° C. to −30° C. Optionally, the hydrotreated diesel boiling range composition can correspond to a heavy diesel, with a T10 distillation point of 240° C. or more. In such optional aspects, the hydrotreated diesel boiling range composition can include a density at 15° C. of 820 kg/m$^3$ to 835 kg/m$^3$, a cetane index of 60 or more, or 75 or more, such as up to 80 or possibly still higher; a T90 distillation point of 375° C. or less, or 360° C. or less, or 320° C. or less, such as down to 280° C., or possibly still lower; and/or a pour point of −20° C. to 10° C.

In some aspects, a diesel boiling range fraction prior to hydrotreatment can correspond to a diesel fraction with a naphthenes to aromatics weight ratio of 1.6 or more, or 2.5 or more, or 2.6 or more, or 2.8 or more, with an aromatics content of 4.5 wt % to 25 wt %, a sulfur content of 1000 wppm or less, and a weight ratio of aliphatic sulfur to total sulfur of 0.15 or more. In such aspects, it can be desirable to perform low severity hydrotreating on the distillate boiling range fraction, followed by aromatic saturation to produce a hydrotreated, aromatic saturated product with an aromatics content of 5 wt % to 10 wt % and a sulfur content of 10 wppm or less. Based on the additional naphthenes created during aromatic saturation, the naphthene content of the hydrotreated, aromatic saturated product can be 45 wt % to 57 wt %. This results in a naphthenes to aromatics weight ratio of 2.0 or more, or 3.0 or more, or 4.0 or more, or 5.0 or more, or 6.0 or more, or 8.0 or more, such as up to 10.0 or possibly still higher. Based on use of low severity hydrotreating, when used as a fuel, this hydrotreated, aromatic saturated fraction can have a carbon intensity that is 1% to 10% less than a conventional diesel fuel. This hydrotreated, aromatic saturated fraction can have a carbon intensity of 90 g $CO_2$eq/MJ of lower heating value or less, or 88 g $CO_2$eq/MJ of lower heating value or less, such as down to 86 g $CO_2$eq/MJ of lower heating value or possibly still lower.

Still other properties of an aromatic saturated, hydrotreated diesel boiling range composition can include a density at 15° C. of 790 kg/m$^3$ to 835 kg/m$^3$, or 790 kg/m$^3$ to 820 kg/m$^3$, or 810 kg/m$^3$ to 835 kg/m$^3$, or 810 kg/m$^3$ to 820 kg/m$^3$; a cetane index of 57 or more, or 60 or more, or 70 or more, or 80 or more, such as up to 90 or possibly still higher; a cetane number of 59 or more, or 60 or more, such as up to 70 or possibly still higher; a ratio of cetane index to weight percent of aromatics of 6.0 or higher, or 8.0 or higher, or 10.0 or higher, or 13.0 or higher, such as up to 25 or possibly still higher; a ratio of cetane number to weight percent of aromatics of 7.0 or higher, or 8.0 or higher, or 10.0 or higher, or 13.0 or higher, such as up to 25 or possibly still higher; a T90 distillation point of 375° C. or less, or 360° C. or less, or 320° C. or less, such as down to 280° C., or possibly still lower; and/or a cloud point of −15° C. or higher, or −10° C. or higher. Optionally, the aromatic saturated, hydrotreated diesel boiling range composition can correspond to a heavy diesel, with a T10 distillation point of 240° C. or more, or 250° C. or more, or 260° C. or more. In such optional aspects, the hydrotreated diesel boiling range composition can include a density at 15° C. of 810 kg/m$^3$ to 835 kg/m$^3$, or 820 kg/m$^3$ to 835 kg/m$^3$, a cetane index of 64 or more, or 70 or more, such as up to 80 or possibly still higher; a cetane number of 65 or more, or 70 or more, such as up to 80 or possibly still higher; a ratio of cetane index to weight percent aromatics of 8.0 or higher, or 10.0 or higher, or 13.0 or higher, such as up to 25 or possibly still higher; a ratio of cetane number to weight percent aromatics of 7.0 or higher, or 8.0 or higher, or 10.0 or higher, or 13.0 or higher, such as up to 25 or possibly still higher; a T90 distillation point of 375° C. or less, or 360° C. or less, or 320° C. or less, such as down to 280° C., or possibly still lower; and/or a cloud point of 0° C. or higher.

In some aspects, the distillate boiling range fraction prior to hydrotreatment can correspond to a distillate fraction with a naphthenes to aromatics weight ratio of 2.5 or more, or 2.6 or more, or 2.8 or more, with an aromatics content of 4.5 wt % to 25 wt %, a sulfur content of 1000 wppm or less, and a weight ratio of aliphatic sulfur to total sulfur of 0.15 or more.

Optionally, in addition to performing low severity hydrotreating and aromatic saturation, it can also be desirable to perform ring opening on the distillate/diesel boiling range fraction. This can produce a hydrotreated, aromatic saturated, ring-opened product with an aromatics content of 4.5 wt % to 10 wt % (or 5.0 wt % to 10 wt %), a naphthenes content of 12 wt % to 35 wt %, and a sulfur content of 10 wppm or less. This combination of processes can lead to a low sulfur diesel fuel with the unexpected combination of features of an increased cetane rating while still have a reduced carbon intensity.

Still other properties of a ring-opened, aromatic saturated, hydrotreated diesel boiling range composition can include a density at 15° C. of 780 kg/m$^3$ to 820 kg/m$^3$; or 790 kg/m$^3$ to 810 kg/m$^3$; a cetane index of 60 or more, or 65 or more, or 75 or more, or 80 or more, such as up to 90 or possibly still higher; a T90 distillation point of 375° C. or less, or 360° C. or less, or 320° C. or less, such as down to 280° C. or possibly still lower; and/or a cloud point of −15° C. or higher, or −10° C. or higher. Optionally, the aromatic saturated, hydrotreated diesel boiling range composition can correspond to a heavy diesel, with a T10 distillation point of 240° C. or more, or 250° C. or more, or 260° C. or more. In such optional aspects, the hydrotreated diesel boiling range composition can include a cetane index of 75 or more, or 80 or more, such as up to 90 or possibly still higher; a T90 distillation point of 375° C. or less, or 360° C. or less, or 320° C. or less, such as down to 280° C. or possibly still lower; and/or a cloud point of 0° C. or higher. Optionally, catalytic dewaxing can be performed after ring opening to reduce the cloud point and/or pour point of the ring-opened fraction.

A distillate/diesel boiling range fuel with a high ratio of naphthenes to aromatics, a low sulfur content, and a low but substantial aromatics content can also provide other advantages. For example, based on the low content of aromatics, the diesel/distillate boiling range fuel can have a high cetane index. For a straight run fraction or a fraction exposed to mild severity hydrotreatment, the cetane index can be 49 or more, or 55 or more, or 60 or more, or 65 or more, such as up to 75 or possibly still higher. For a fraction that is also exposed to aromatic saturation conditions, the cetane index can be 55 or more, or 57 or more, or 60 or more, or 65 or more, or 70 or more, such as up to 79 or possibly still higher. For a fraction that is exposed to low severity hydrotreatment conditions, aromatic saturation conditions, and ring opening conditions, the cetane index can be 60 or more, or 70 or more, or 75 or more, or 80 or more, such as up to 95 or possibly still higher. Additionally, for a straight run fraction or a fraction exposed to mild severity hydrotreatment, the ratio of cetane index to weight percent of aromatics can be 2.0 or higher, or 2.5 or higher, or 4.0 or higher, or 6.0 or higher, or 8.0 or higher, or 10 or higher, such as up to 25, or potentially still higher. For a fraction that is exposed to low severity hydrotreatment conditions, aromatic saturation conditions, and ring opening conditions, the ratio of cetane index to weight percent of aromatics can be 6.0 or higher, or 8.0 or higher, or 10 or higher, or 13 or higher, such as up to 25 or potentially still higher.

In addition to having a reduced or minimized carbon intensity as a separate fuel fraction, a distillate boiling range or diesel boiling range fraction having a high naphthenes to aromatics ratio and a low but substantial aromatics content can also be combined with one or more renewable distillate fractions, such as biodiesel fractions, to form a fuel with a reduced carbon intensity. Such a blend has synergistic advantages, as blending a diesel boiling range fraction as described herein with a biodiesel fraction can allow for correction of the pour point of the cold flow properties of the biodiesel (cloud point, freeze point, pour point) while avoiding the need to add a higher carbon intensity fraction to the biodiesel.

In this discussion, renewable blending components can correspond to renewable distillate and/or vacuum gas oil and/or vacuum resid boiling range components that are renewable based on one or more attributes. Some renewable blending components can correspond to components that are renewable based on being of biological origin. Examples of renewable blending components of biological origin can include, but are not limited to, fatty acid methyl esters (FAME), fatty acid alkyl esters, biodiesel, biomethanol, biologically derived dimethyl ether, oxymethylene ether, liquid derived from biomass, pyrolysis products from pyrolysis of biomass, products from gasification of biomass, and hydrotreated vegetable oil. Other renewable blending components can correspond to components that are renewable based on being extracted from a reservoir using renewable energy, such as petroleum extracted from a reservoir using an extraction method that is powered by renewable energy, such as electricity generated by solar, wind, or hydroelectric power. Still other renewable blending components can correspond to blending components that are made or processed using renewable energy, such as Fischer-Tropsch distillate that is formed using processes that are powered by renewable energy, or conventional petroleum distillate that is hydroprocessed/otherwise refinery processed using reactors that are powered by renewable energy. Yet other renewable blending components can correspond to fuel blending components formed from recycling and/or processing of municipal solid waste, or another source of carbon-containing waste. An example of processing of waste is pyrolysis and/or gasification of waste, such as gasification of municipal solid waste.

The lower carbon intensity of a fuel containing at least a portion of a distillate boiling fraction and/or diesel fraction as described herein can be realized by using a fuel containing at least a portion of such a distillate/diesel boiling range fraction in any convenient type of combustion device. In some aspects, a fuel containing at least a portion of a diesel boiling range fraction as described herein can be used as fuel for a combustion engine in a ground transportation vehicle, a marine vessel, or another convenient type of vehicle. Still other types of combustion devices can include generators, furnaces, and other combustion devices that are used to provide heat or power.

Based on the unexpected combinations of compositional properties, the distillate boiling range compositions/diesel boiling range compositions can be used to produce fuels and/or fuel blending products that also generate reduced or minimized amounts of other undesired combustion products. The other undesired combustion products that can be reduced or minimized can include sulfur oxide compounds (SOx) and/or nitrogen oxide compounds (NOx). The low sulfur oxide production is due to the unexpectedly low sulfur content of the compositions. The lower nitrogen oxide production can be due to a corresponding low nitrogen content that is also observed in these low carbon intensity compositions.

It has been discovered that selected shale crude oils are examples of crude oils having an unexpected combination of high naphthenes to aromatics ratio, a low but substantial content of aromatics, and a low sulfur content. In various aspects, a shale oil fraction can be included as part of a fuel or fuel blending product. Examples of shale oils that provide this unexpected combination of properties include selected shale oils extracted from the Permian basin. For convenience, unless otherwise specified, it is understood that references to incorporation of a shale oil fraction into a fuel also include incorporation of such a fraction into a fuel blending product.

Definitions

All numerical values within the detailed description and the claims herein are modified by "about" or "approximately" the indicated value, and take into account experimental error and variations that would be expected by a person having ordinary skill in the art.

In this discussion, a shale crude oil is defined as a petroleum product with a final boiling point greater than 550° C., or greater than 600° C., that is extracted from a shale petroleum source. A shale oil fraction is defined as a boiling range fraction derived from a shale crude oil.

Unless otherwise specified, distillation points and boiling points can be determined according to ASTM D2887. For samples that are not susceptible to characterization using ASTM D2887, D7169 can be used. It is noted that still other methods of boiling point characterization may be provided in the examples. The values generated by such other methods are believed to be indicative of the values that would be obtained under ASTM D2887 and/or D7169.

In this discussion, the jet fuel boiling range or kerosene boiling range is defined as 140° C. to 300° C. A jet fuel boiling range fraction or a kerosene boiling range fraction is defined as a fraction with an initial boiling point of 140° C. or more, a T10 distillation point of 205° C. or less, and a final boiling point of 300° C. or less.

In this discussion, the distillate boiling range is defined as 140° C. to 566° C. A distillate boiling range fraction is defined as a fraction having a T10 distillation point of 140° C. or more and a T90 distillation point of 566° C. or less. The diesel boiling range is defined as 140° C. to 375° C. A diesel boiling range fraction is defined as a fraction having a T10 distillation point of 140° C. or more, a final boiling point of 300° C. or more, and a T90 distillation point of 375° C. or less. An atmospheric resid is defined as a bottoms fraction having a T10 distillation point of 149° C. or higher, or 350° C. or higher. A vacuum gas oil boiling range fraction (also referred to as a heavy distillate) can have a T10 distillation point of 350° C. or higher and a T90 distillation point of 535° C. or less. A vacuum resid is defined as a bottoms fraction having a T10 distillation point of 500° C. or higher, or 565° C. or higher. It is noted that the definitions for distillate boiling range fraction, kerosene (or jet fuel) boiling range fraction, diesel boiling range fraction, atmospheric resid, and vacuum resid are based on boiling point only. Thus, a distillate boiling range fraction, kerosene fraction, or diesel fraction can include components that did not pass through a distillation tower or other separation stage based on boiling point. A shale oil distillate boiling range fraction is defined as a shale oil fraction corresponding to the distillate boiling range. A shale oil kerosene (or jet fuel) boiling range fraction is defined as a shale oil fraction corresponding to the kerosene boiling range. A shale oil diesel boiling range fraction is defined as a shale oil fraction corresponding to the diesel boiling range.

In some aspects, a shale oil fraction that is incorporated into a fuel or fuel blending product can correspond to a shale oil fraction that has not been hydroprocessed and/or that has not been cracked. In this discussion, a non-hydroprocessed fraction is defined as a fraction that has not been exposed to more than 10 psia of hydrogen in the presence of a catalyst comprising a Group VI metal, a Group VIII metal, a catalyst comprising a zeolitic framework, or a combination thereof. In this discussion, a non-cracked fraction is defined as a fraction that has not been exposed to a temperature of 400° C. or more.

In this discussion, a hydroprocessed fraction refers to a hydrocarbon fraction and/or hydrocarbonaceous fraction that has been exposed to a catalyst having hydroprocessing activity in the presence of 300 kPa-a or more of hydrogen at a temperature of 200° C. or more. Examples of hydroprocessed fractions include hydroprocessed distillate fractions (i.e., a hydroprocessed fraction having the distillate boiling range), hydroprocessed kerosene fractions (i.e., a hydroprocessed fraction having the kerosene boiling range) and hydroprocessed diesel fractions (i.e., a hydroprocessed fraction having the diesel boiling range). It is noted that a hydroprocessed fraction derived from a biological source, such as hydrotreated vegetable oil, can correspond to a hydroprocessed distillate fraction, a hydroprocessed kerosene fraction, and/or a hydroprocessed diesel fraction, depending on the boiling range of the hydroprocessed fraction. A hydroprocessed fraction can be hydroprocessed prior to separation of the fraction from a crude oil or another wider boiling range fraction.

With regard to characterizing properties of diesel/distillate boiling range fractions and/or blends of such fractions with other components to form diesel boiling range fuels, a variety of methods can be used. Distillation for boiling ranges and fractional distillation points (° C.) can be determined according to ASTM D2887. (Where noted, some values were determined herein using ASTM D86, but are believed to be comparable to the ASTM D2887 values.) For compositional features, such as the amounts of paraffins, isoparaffins, olefins, naphthenes, and/or aromatics (Wt %) in a crude oil and/or crude oil fraction, can be determined according to ASTM D5186. Olefin content (Wt %) can be determined according to the method described by the Kapur et al. reference noted in the Background. Hydrogen and carbon content (Wt %) can be determined according to D3343. Density of a blend at 15° C. or 15.6° C. (kg/m$^3$) can be determined according ASTM D4052. Kinematic viscosity at 40° C. (cSt) can be determined according to ASTM D445. (Where noted, some values were determined herein using ASTM D7042, but are believed to be comparable to ASTM D445 values). Sulfur (in wppm or wt %) can be determined according to ASTM D2622, but some values determined herein may have been determined according to ASTM D4294 or ASTM D5443. Aliphatic sulfur (Wt %) can be determined according to the method described by the Drushel and Miller reference that is noted in the Background. Nitrogen (in wppm or wt %) can be determined according to ASTM D4629. Basic nitrogen (Wt %) can be determined according to the method described by the White et al. reference that is noted in the Background. Pour point (° C.) can be determined according to ASTM D97. (Where noted, some values that are believed to be equivalent may have been determined according to ASTM D5949.) Cloud point (° C.) can be determined according to ASTM D2500. (Where noted, some values that are believed to be equivalent may have been determined according to ASTM D5773.) Freeze point (° C.) can be determined according to ASTM D5972. Cold filter plugging point (° C.) can be determined according to ASTM D6371. Smoke point (mm) can be determined according to ASTM D1322. Flash point (° C.) can be determined according to ASTM D93. (Where noted, some values that are believed to be equivalent may have been determined according to D6450). Data related to cetane number can be determined according to ASTM D613. Data related to derived cetane number can be determined according to ASTM D6890. Data related to cetane index can be determined according to ASTM D4737 procedure A. Net heat of combustion (MJ/kg) can be determined according to ASTM D3338. Volumetric heating value (WI) can be determined through conversion of net heat of combustion using sample density. FAME content (Vol %) can be determined according to EN 14078. Ester content (m/m %) can be determined according to EN 14103.

With regard to determining paraffin, naphthene, and aromatics contents, supercritical fluid chromatography (SFC) was used. The characterization was performed using a commercial supercritical fluid chromatograph system, and the methodology represents an expansion on the methodology described in ASTM D5186 to allow for separate characterization of paraffins and naphthenes. The expansion on the ASTM D5186 methodology was enabled by using additional separation columns, to allow for resolution of naphthenes and paraffins. The system was equipped with the following components: a high pressure pump for delivery of supercritical carbon dioxide mobile phase; temperature controlled column oven; auto-sampler with high pressure liquid injection valve for delivery of sample material into mobile phase; flame ionization detector; mobile phase splitter (low dead volume tee); back pressure regulator to keep the $CO_2$ in supercritical state; and a computer and data system for control of components and recording of data signal. For analysis, approximately 75 milligrams of sample was diluted in 2 milliliters of toluene and loaded in standard septum cap autosampler vials. The sample was introduced based via the high pressure sampling valve. The SFC separation was performed using multiple commercial silica packed columns (5 micron with either 60 or 30 angstrom pores) connected in series (250 mm in length either 2 mm or 4 mm ID). Column temperature was held typically at 35 or 40° C. For analysis, the head pressure of columns was typically 250 bar. Liquid $CO_2$ flow rates were typically 0.3 ml/minute for 2 mm ID columns or 2.0 ml/minute for 4 mm ID columns. The SFC FID signal was integrated into paraffin and naphthenic regions. In addition to characterizing aromatics according to ASTM D5186, a supercritical fluid chromatograph was used to analyze samples for split of total paraffins and total naphthenes. A variety of standards employing typical molecular types can be used to calibrate the paraffin/naphthene split for quantification. It is noted that some values reported in FIG. 12 were determined according to the NOISE method rather than according to this expanded version of ASTM D5186.

In this discussion, the term "paraffin" refers to a saturated hydrocarbon chain. Thus, a paraffin is an alkane that does not include a ring structure. The paraffin may be straight-chain or branched-chain and is considered to be a non-ring compound. "Paraffin" is intended to embrace all structural isomeric forms of paraffins.

In this discussion, the term "naphthene" refers to a cycloalkane (also known as a cycloparaffin). Therefore, naphthenes correspond to saturated ring structures. The term naphthene encompasses single-ring naphthenes and multi-ring naphthenes. The multi-ring naphthenes may have two or more rings, e.g., two-rings, three-rings, four-rings, five-rings, six-rings, seven-rings, eight-rings, nine-rings, and ten-rings. The rings may be fused and/or bridged. The naphthene can also include various side chains, such as one or more alkyl side chains of 1-10 carbons.

In this discussion, the term "saturates" refers to all straight chain, branched, and cyclic paraffins. Thus, saturates correspond to a combination of paraffins and naphthenes.

In this discussion, the term "aromatic ring" means five or six atoms joined in a ring structure wherein (i) at least four of the atoms joined in the ring structure are carbon atoms and (ii) all of the carbon atoms joined in the ring structure are aromatic carbon atoms. Therefore, aromatic rings correspond to unsaturated ring structures. Aromatic carbons can be identified using, for example, $^{13}C$ Nuclear Magnetic Resonance. Aromatic rings having atoms attached to the ring (e.g., one or more heteroatoms, one or more carbon atoms, etc.) but which are not part of the ring structure are within the scope of the term "aromatic ring." Additionally, it is noted that ring structures that include one or more heteroatoms (such as sulfur, nitrogen, or oxygen) can correspond to an "aromatic ring" if the ring structure otherwise falls within the definition of an "aromatic ring".

In this discussion, the term "non-aromatic ring" means four or more carbon atoms joined in at least one ring structure wherein at least one of the four or more carbon atoms in the ring structure is not an aromatic carbon atom. Non-aromatic rings having atoms attached to the ring (e.g., one or more heteroatoms, one or more carbon atoms, etc.), but which are not part of the ring structure, are within the scope of the term "non-aromatic ring."

In this discussion, the term "aromatics" refers to all compounds that include at least one aromatic ring. Such compounds that include at least one aromatic ring include compounds that have one or more hydrocarbon substituents. It is noted that a compound including at least one aromatic ring and at least one non-aromatic ring falls within the definition of the term "aromatics".

It is noted that that some hydrocarbons present within a feed or product may fall outside of the definitions for paraffins, naphthenes, and aromatics. For example, any alkenes that are not part of an aromatic compound would fall outside of the above definitions. Similarly, non-aromatic compounds that include a heteroatom, such as sulfur, oxygen, or nitrogen, are not included in the definition of paraffins or naphthenes.

Categories of Fuels

A fuel is a gaseous, liquid, or solid material used as an energy source for combustion devices, including but not limited to combustion engines in land-based, aeronautical, or marine vehicles, combustion engines in generators, furnaces, boilers, and other combustion devices that are used to provide heat or power. A fuel composition is understood to refer to a gaseous, liquid, or solid material that can be used as a fuel. For certain combustion devices, proper combustion or operation of the combustion device may be ensured by controlling fuel properties. The necessary properties of a fuel for specific combustion devices may be specified in standard specification documents. In order to be suitable for its end use application in a combustion engine or other combustion device, a gaseous, liquid, or solid material may require the addition of one or more fuel additives. Fuels may be derived from renewable or conventional sources, or a combination of both. A blend of one or more fatty acid alkyl esters with a resid-containing fraction can be referred to as a fuel composition.

A fuel blending component, also referred to herein as "component" or a fuel "fraction," which may be used interchangeably in the specification and the claims, refers to a liquid constituent that is blended with other fuel blending components, components, or fuel fractions into the overall fuel composition. In some cases fuel blending components may possess the appropriate properties for use in a combustion device without further modification. Fuel blending components may be combined (blended) with fuels, other fuel blending components, or fuel additives to form a finished fuel or fuel composition that possesses the appropriate properties for use in a combustion device. Fuel blending components may be derived from renewable or conventional sources.

A conventional fuel is a fuel or fuel composition derived from one or more conventional fuel blending components. Conventional fuel blending components are derived from conventional hydrocarbon sources such as crude oil, natural gas, liquid condensates, heavy oil, shale oil, and oil sands, as described in ASTM D4175.

A renewable fuel is a fuel or fuel composition derived from one or more renewable blending components. Renewable blending components are derived from naturally-replenishing energy sources, such as biomass, water, and electricity produced from hydropower, wind, solar, or geothermal sources. Biofuels are a subset of renewable fuels manufactured from biomass-derived feedstocks (e.g. plant or animal based materials). Examples of biofuels include, but are not limited to, fatty acid methyl esters and hydrotreated vegetable oils. The distillate boiling range fraction of a hydrotreated vegetable oil (HVO) is also referred to as renewable diesel.

A hydrocarbon is a compound composed only of hydrogen and carbon atoms. As described in ASTM D4175, hydrocarbon fuels consist primarily of hydrocarbon compounds, but may also contain impurities and contaminants from the fuel's raw materials and manufacturing processes.

Life Cycle Assessment and Carbon Intensity

Life cycle assessment (LCA) is a method of quantifying the "comprehensive" environmental impacts of manufactured products, including fuel products, from "cradle to grave". Environmental impacts may include greenhouse gas (GHG) emissions, freshwater impacts, or other impacts on the environment associated with the finished product. The general guidelines for LCA are specified in ISO 14040.

The "carbon intensity" of a fuel product (e.g. diesel fuel) is defined as the life cycle GHG emissions associated with that product (g $CO_2$eq) relative to the energy content of that fuel product (MJ, LHV basis). Life cycle GHG emissions associated with fuel products must include GHG emissions associated with crude oil production; crude oil transportation to a refinery; refining of the crude oil; transportation of the refined product to point of "fill"; and combustion of the fuel product.

GHG emissions associated with the stages of refined product life cycles are assessed as follows.

(1) GHG emissions associated with drilling and well completion—including hydraulic fracturing, shall be normalized with respect to the expected ultimate recovery of sales-quality crude oil from the well.

(2) All GHG emissions associated with the production of oil and associated gas, including those associated with (a) operation of artificial lift devices, (b) separation of oil, gas, and water, (c) crude oil stabilization and/or upgrading, among other GHG emissions sources shall be normalized with respect to the volume of oil transferred to sales (e.g. to crude oil pipelines or rail). The fractions of GHG emissions associated with production equipment to be allocated to crude oil, natural gas, and other hydrocarbon products (e.g. natural gas liquids) shall be specified accordance with ISO 14040.

(3) GHG emissions associated with rail, pipeline or other forms of transportation between the production site(s) to the refinery shall be normalized with respect to the volume of crude oil transferred to the refinery.

(4) GHG emissions associated with the refining of crude oil to make liquefied petroleum gas, gasoline, distillate fuels and other products shall be assessed, explicitly accounting for the material flows within the refinery. These emissions shall be normalized with respect to the volume of crude oil refined.

(5) All of the preceding GHG emissions shall be summed to obtain the "Well to refinery" (WTR) GHG intensity of crude oil (e.g. kg $CO_2$eq/bbl crude).

(6) For each refined product, the WTR GHG emissions shall be divided by the product yield (barrels of refined product/barrels of crude), and then multiplied by the share of refinery GHG specific to that refined product. The allocation procedure shall be conducted in accordance with ISO 14040. This procedure yields the WTR GHG intensity of each refined product (e.g. kg $CO_2$eq/bbl gasoline).

(7) GHG emissions associated with rail, pipeline or other forms of transportation between the refinery and point of fueling shall be normalized with respect to the volume of each refined product sold. The sum of the GHG emissions associated with this step and the previous step of this procedure is denoted the "Well to tank" (WTT) GHG intensity of the refined product.

(8) GHG emissions associated with the combustion of refined products shall be assessed and normalized with respect to the volume of each refined product sold.

(9) The "carbon intensity" of each refined product is the sum of the combustion emissions (kg $CO_2$eq/bbl) and the "WTT" emissions (kg $CO_2$eq/bbl) relative to the energy value of the refined product during combustion. This corresponds to the "well to wheel" value. Following the convention of the EPA Renewable Fuel Standard 2, these emissions are expressed in terms of the low heating value (LHV) of the fuel, i.e. g $CO_2$eq/MJ refined product (LHV basis).

In the above methodology, the dominant contribution for the amount of $CO_2$ produced per MJ of refined product is the $CO_2$ formed during combustion of the product. Because the $CO_2$ generated during combustion is such a high percentage of the total carbon intensity, achieving even small or incremental reductions in carbon intensity has traditionally been challenging. In various aspects, it has been discovered that kerosene fractions derived from selected crude oils can be used to form fuels with reduced carbon intensities. The selected crude oils correspond to crude oils with high naphthenes to aromatics ratios, low sulfur content, and a low but substantial aromatics content. This combination of features can allow for formation of a kerosene fraction from the crude oil that requires a reduced or minimized amount of refinery processing in order to make a fuel product and/or fuel blending product.

In this discussion, a low carbon intensity fuel or fuel blending product corresponds to a fuel or fuel blending product that has reduced GHG emissions per unit of lower of heating value relative to a fuel or fuel blending product derived from a conventional petroleum source. In some aspects, the reduced GHG emissions can be due in part to reduced refinery processing. For example, fractions that are not hydroprocessed for sulfur removal have reduced well-to-refinery emissions relative to fractions that require hydroprocessing prior to incorporation into a fuel. In various aspects, an unexpectedly high weight ratio of naphthenes to aromatics in a shale oil fraction can indicate a fraction with reduced GHG emissions, and therefore a lower carbon intensity.

For a conventionally produced diesel fuel, a "well to wheel" carbon intensity of 92 g $CO_2$eq/MJ refined product or more would be expected based on life cycle analysis. By reducing or minimizing refinery processing, such as by avoiding hydroprocessing, the carbon intensity for a fuel can be reduced by 1% to 10% relative to a conventional fuel. This can result in, for example, a distillate heating fuel or a diesel fuel with a carbon intensity of 90 g $CO_2$eq/MJ refined product or less, or 88.0 g $CO_2$eq/MJ refined product or less, or 86.0 g $CO_2$eq/MJ refined product or less, such as down to 82 g $CO_2$eq/MJ refined product or possibly still lower.

Another indicator of a low carbon intensity fuel can be an elevated ratio of aliphatic sulfur to total sulfur in a fuel or fuel blending product. Aliphatic sulfur is generally easier to remove than other types of sulfur present in a hydrocarbon fraction. In a hydrotreated fraction, the aliphatic sulfur will typically be removed almost entirely, while other types of sulfur species will remain. The presence of increased aliphatic sulfur in a product can indicate a lack of hydroprocessing for the product.

Still another indicator of a low carbon intensity fuel can be an elevated ratio of basic nitrogen to total nitrogen in a fuel or fuel blending product. Basic nitrogen is typically easier to remove by hydrotreatment. The presence of an increased amount of basic nitrogen in a product can therefore indicate a lack of hydroprocessing for the product.

Yet other ways of reducing carbon intensity for a hydrocarbon fraction can be related to methods used for extraction of a crude oil. For example, carbon intensity for a fraction can be reduced by using solar power, hydroelectric power, or another renewable energy source as the power source for equipment involved in the extraction process, either during drilling and well completion and/or during production of crude oil. As another example, extracting crude oil from an extraction site without using artificial lift can reduce the carbon intensity associated with a fuel.

As an example of the benefits of using lower carbon intensity methods for extraction, if crude oil is produced with an upstream GHG intensity of 10 kg $CO_2$eq/bbl, has 3.0 wt % sulfur or less, and an API gravity of 40 or more, then a substantial majority of the time, an ultra-low sulfur diesel refined from such a crude oil can have a "well to wheel" GHG intensity that is 10% lower than the conventional value of 92 g $CO_2$eq/MJ refined product or more.

As another example, if crude oil is produced with an upstream GHG intensity of 10 kg $CO_2$eq/bbl, has 3.0 wt % sulfur or less, and an API gravity of 30 or more, then a majority of the time, an ultra-low sulfur diesel refined from such a crude oil can have a "well to wheel" GHG intensity (otherwise known as "carbon intensity") that is 10% lower than the conventional value of 92 g $CO_2$eq/MJ refined product or more.

As still another example, if crude oil is produced with an upstream GHG intensity of 30 kg $CO_2$eq/bbl, has 3.0 wt % sulfur or less, and an API gravity of 40 or more, then a majority of the time, an ultra-low sulfur diesel refined from such a crude oil can have a "well to wheel" GHG intensity (otherwise known as "carbon intensity") that is 10% lower than the conventional value of 92 g $CO_2$eq/MJ refined product or more.

As yet another example, if crude oil is produced with an upstream GHG intensity of 20 kg $CO_2$eq/bbl, has 3.0 wt % sulfur or less, and an API gravity of 40 or more, then a substantial majority of the time, an ultra-low sulfur diesel refined from such a crude oil can have a "well to wheel"

GHG intensity (otherwise known as "carbon intensity") that is 10% lower than the conventional value of 92 g $CO_2$eq/MJ refined product or more.

Optional Treatment of Diesel and/or Distillate Fractions

In some aspects, a distillate boiling range fraction or diesel boiling range fraction can be used as a heating fuel, marine fuel, or an automotive fuel without hydroprocessing of the distillate fraction. In other aspects, one or more types of processing can be performed on a distillate boiling range fraction or diesel boiling range fraction. Examples of types of processing include, but are not limited to, hydrotreatment, catalytic dewaxing, aromatic saturation, and ring opening.

Optionally, a distillate boiling range fraction or diesel boiling range fraction can be treated in one or more hydrotreatment stages. The hydrotreatment can be performed before or after fractionation to form the distillate boiling range fraction or diesel boiling range fraction.

The reaction conditions in a hydrotreatment stage can be conditions suitable for reducing the sulfur content of the feedstock. Due to the already low sulfur content of the distillate/diesel boiling range fraction, in some aspects the hydrotreatment conditions can correspond to low severity hydrotreatment conditions. In such aspects, the low severity hydrotreatment conditions can include an LHSV of 0.3 to 5.0 $hr^{-1}$, a total pressure from 200 psig (1.4 MPag) to 1000 psig (~6.9 MPag), a treat gas containing 80% or more hydrogen (remainder inert gas), and a temperature of from 500° F. (260° C.) to 660° F. (~350° C.). The treat gas rate can be from 500 SCF/bbl (~85 $Nm^3/m^3$) to about 5000 SCF/bbl (~850 $Nm^3/m^3$) of hydrogen. In other aspects, general hydrotreatment conditions can be used. In such aspects, the general hydrotreatment conditions can include an LHSV of 0.2 to 1.8 $hr^{-1}$, a total pressure from 600 psig (4.2 MPag) to 1200 psig (~8.3 MPag), a treat gas containing 80% or more hydrogen (remainder inert gas), and a temperature of from 500° F. (260° C.) to 800° F. (~427° C.). The treat gas rate can be from 800 SCF/bbl (136 $Nm^3/m^3$) to 4000 SCF/bbl (~680 $Nm^3/m^3$) of hydrogen. Note that the above treat gas rates refer to the rate of hydrogen flow. If hydrogen is delivered as part of a gas stream having less than 100% hydrogen, the treat gas rate for the overall gas stream can be proportionally higher.

In some aspects of the disclosure, the hydrotreatment stage(s) can reduce the sulfur content of the feed to a suitable level. For example, the sulfur content can be reduced to 20 wppm or less, or 10 wppm or less, or 1.0 wppm or less, such as down to 0.05 wppm or possibly still lower.

The catalyst in a hydrotreatment stage can be a conventional hydrotreating catalyst, such as a catalyst composed of a Group VIB metal (Group 6 of IUPAC periodic table) and/or a Group VIII metal (Groups 8-10 of IUPAC periodic table) on a support. Suitable metals include cobalt, nickel, molybdenum, tungsten, or combinations thereof. Preferred combinations of metals include nickel and molybdenum or nickel, cobalt, and molybdenum. Suitable supports include silica, silica-alumina, alumina, and titania.

After hydrotreatment, the hydrotreated effluent can optionally but preferably be separated, such as by separating the gas phase effluent from a liquid phase effluent, in order to remove gas phase contaminants generated during hydrotreatment. Alternatively, in some aspects the entire hydrotreated effluent can be cascaded into the catalytic dewaxing stage(s).

Optionally, a hydrotreated fraction can be subsequently exposed to aromatic saturation conditions to reduce the aromatics content of the distillate boiling range fraction or diesel boiling range fraction to 5.0 wt % to 10 wt %. Hydrofinishing catalysts can include catalysts containing Group VI metals, Group VIII metals, and mixtures thereof. In an embodiment, preferred metals include at least one metal sulfide having a strong hydrogenation function. In another embodiment, the hydrofinishing catalyst can include a Group VIII noble metal, such as Pt, Pd, or a combination thereof. The mixture of metals may also be present as bulk metal catalysts wherein the amount of metal is about 30 wt. % or greater based on catalyst. Suitable metal oxide supports include low acidic oxides such as silica, alumina, silica-aluminas or titania, preferably alumina. The preferred hydrofinishing catalysts for aromatic saturation will comprise at least one metal having relatively strong hydrogenation function on a porous support. Typical support materials include amorphous or crystalline oxide materials such as alumina, silica, and silica-alumina. The support materials may also be modified, such as by halogenation, or in particular fluorination. The metal content of the catalyst is often as high as about 20 weight percent for non-noble metals. In an embodiment, a preferred hydrofinishing catalyst can include a crystalline material belonging to the M41S class or family of catalysts. The M41S family of catalysts are mesoporous materials having high silica content. Examples include MCM-41, MCM-48 and MCM-50. A preferred member of this class is MCM-41.

Hydrofinishing conditions can include temperatures from 125° C. to 425° C., or 180° C. to 280° C., a total pressure from 200 psig (1.4 MPa) to 800 psig (5.5 MPa), or 400 psig (2.8 MPa) to 700 psig (4.8 MPa), and a liquid hourly space velocity from 0.1 $hr^{-1}$ to 5 $hr^{-1}$ LHSV, preferably 0.5 $hr^{-1}$ to 1.5 $hr^{-1}$. The treat gas rate can be selected to be similar to a hydrotreatment stage or any other convenient selection.

In some aspects, a hydrotreated (and optionally aromatic saturated) distillate boiling range fraction or diesel boiling range fraction can be exposed to ring opening conditions to convert a portion of the naphthenes in the fraction into paraffins. An example of a ring opening process is described in U.S. Pat. No. 6,883,020. Briefly, an example of a naphthene ring opening catalyst is 0.01 wt % to 2.0 wt % iridium on a composite support of alumina and acidic silica-alumina molecular sieve, with the acidic silica-alumina molecular sieve preferably having a Si/Al atomic ratio of at least about 30, more preferably at least about 40, most preferably at least about 60, prior to compositing with the alumina. Preferably, the alumina component in the support is present in a range of from about 99 to about 1 wt. %, and the acidic silica-alumina molecular sieve component is present in a range of from about 1 to about 99 wt. %. The weight percents are based on the weight of the composite support. Optionally, the catalyst can further include at least one other Group VIII metal selected from Pt, Pd, Rh, or Ru. Preferably, the second Group VIII metal or metals is present in a range of from about 0.01 wt % to about 5 wt %, based on the weight of the ring opening catalyst.

Ring opening can be carried out at a temperature ranging from 150° C. to 400° C.; a total pressure ranging from 100 psig (0.7 MPag) to 3,000 psig (20.7 MPag); a liquid hourly space velocity ranging from 0.1 to 10 $hr^{-1}$; and a hydrogen treat gas rate ranging from 200 to 10,000 standard cubic feet per barrel (SCF/B) (~34 $Nm^3/m^3$ to 1700 $Nm^3/m^3$).

Catalytic dewaxing can be used to improve the cold flow properties of a fraction that has been exposed to hydrotreatment, aromatic saturation, and/or ring opening. In some aspects, dewaxing catalysts can be selected from molecular sieves such as crystalline aluminosilicates (zeolites) or silico-aluminophosphates (SAPOs). In this discussion, molecular sieves are defined to include crystalline materials having a recognized zeolite framework structure, including crystalline materials having a framework structure recognized by the International Zeolite Association. The framework atoms in the molecular sieve framework structure can correspond to a zeolite (silicoaluminate) structure, an aluminophosphate structure, a silicoaluminophosphate structure, a metalloaluminphosphate structure, or any other conventionally know combination of framework atoms that can form a corresponding zeolitic framework structure. Thus, under this definition, crystalline materials having framework types corresponding to larger ring channels, such as 12-member ring channels, are included within the definition of a molecular sieve. In an aspect, the molecular sieve can be a 1-D or 3-D molecular sieve. In an aspect, the molecular sieve can be a 10-member ring 1-D molecular sieve. Examples of molecular sieves can include ZSM-48, ZSM-23, ZSM-35, ZSM-12, and combinations thereof. In an embodiment, the molecular sieve can be ZSM-48, ZSM-23, or a combination thereof. Still other suitable molecular sieves can include SSZ-32, EU-2, EU-11, and/or ZBM-30. In other aspects, a dewaxing catalyst can more generally correspond to any of a variety of dewaxing catalysts that conventionally have been used for distillate dewaxing. This can include any of various dewaxing catalysts based on a molecular sieve, usually having at least a 10-member ring or a 12-member ring pore channel.

The dewaxing catalyst can also include a metal hydrogenation component, such as a Group VIII metal (Groups 8-10 of IUPAC periodic table). Suitable Group VIII metals can include Pt, Pd, or Ni. Preferably the Group VIII metal is a noble metal, such as Pt, Pd, or a combination thereof. The dewaxing catalyst can include at least about 0.1 wt % of a Group VIII metal, such as at least 0.5 wt %, or at least 1.0 wt %. Additionally or alternately, the dewaxing catalyst can include 10.0 wt % or less of a Group VIII metal, such as 5.0 wt % or less, or 3.5 wt % or less. For example, the dewaxing catalyst can include from 0.1 wt % to 10.0 wt % of a Group VIII metal, or 0.1 wt % to 5.0 wt %, or 0.1 wt % to 3.5 wt %.

Catalytic dewaxing can be performed by exposing a feedstock to a dewaxing catalyst under effective (catalytic) dewaxing conditions. Effective dewaxing conditions can include a temperature of 500° F. (260° C.) to 750° F. (399° C.); a pressure of 200 psig (1.4 MPa) to 1500 psig (~10 MPa); a Liquid Hourly Space Velocity (LHSV) of 0.5 $hr^{-1}$ to 5.0 hr'; and a (hydrogen-containing) treat gas rate of 500 SCF/bbl (~84 $m^3/m^3$) to 10000 SCF/bbl (1700 $m^3/m^3$).

FIG. 8 shows an example of a configuration for performing one or more of the above types of processing. In the example shown in FIG. 8, a feed 101 corresponding to a crude oil or crude fraction is passed into a hydrotreatment stage 110 to produce a hydrotreated crude or crude fraction 115. The hydrotreated crude or crude fraction 115 can then be fractionated 120 to form, for example, a naphtha fraction 122, a diesel fraction 125, and one or more heavier fractions 127.

The diesel fraction can then be exposed to one or more optional processing stages. The optional processing stages include aromatic saturation stage 130, ring opening stage 140, and catalytic dewaxing stage 150. After any optional processing stages, a final diesel product fraction 155 is produced. It is noted that the order of processing shown in FIG. 8 can be varied. For example, hydrotreatment stage 110 can be located after fractionator 120. As another example, catalytic dewaxing stage 150 can be located prior to aromatic saturation stage 130.

Characterization of Shale Crude Oils and Shale Oil Fractions—General

Shale crude oils were obtained from a plurality of different shale oil extraction sources. Assays were performed on the shale crude oils to determine various compositional characteristics and properties for the shale crude oils. The shale crude oils were also fractionated to form various types of fractions, including fractionation into atmospheric resid fractions, vacuum resid fractions, distillate fractions (including kerosene, diesel, and vacuum gas oil boiling range fractions), and naphtha fractions. Various types of characterization and/or assays were also performed on these additional fractions.

The characterization of the shale crude oils and/or crude oil fractions included a variety of procedures that were used to generate data. For distillate and/or diesel fractions described herein, the characterization methods described previously were used. For other crude oils and/or crude oil fractions, various procedures were used to generate data. For example, data for boiling ranges and fractional distillation points was generated using methods similar to compositional or pseudo compositional analysis such as ASTM D2887 or ASTM D86. For compositional features, such as the amounts of paraffins, isoparaffins, olefins, naphthenes, and/or aromatics in a crude oil and/or crude oil fraction, data was generated using methods similar to compositional analysis such as ASTM D5186, nitric oxide ionization spectrometry evaluation ("NOISE") hydrocarbon analysis (available from Triton Analytics Corporation, Houston, Tex.), and/or other gas chromatography techniques. Olefin composition was determined using $^1H$ NMR by a method similar to that described in the article by Kapur et al referenced in the Background. Data related to Hydrogen and carbon content was measured using methods similar to D3343. Data related to density (such as density at 15° C. or 15.6° C.) and API Gravity was generated using methods similar to ASTM D1298 and/or ASTM D4052. Data related to kinematic viscosity (such as kinematic viscosity at 40° C.) was generated using methods similar to ASTM D445 and/or ASTM D7042. Data related to sulfur content of a crude oil and/or crude oil fraction was generated using methods similar to ASTM D2622, ASTM D4294, and/or ASTM D5443. Data related to aliphatic sulfur was generated using methods similar to that described in the article by Drushel and Miller referenced in the Background. Data related to nitrogen content was generated using methods similar to D4629. Data related to basic nitrogen content was generated using methods similar to the article by White et al. referenced in the Background. Data related to pour point was generated using methods similar to ASTM D97 and/or ASTM D5949. Data related to cloud point was generated using methods similar to ASTM D2500 and/or ASTM D5773. Data related to freeze point was generated using methods similar to D5972. Data related to cold filter plugging point was generated using methods similar to D6371. Data related to smoke point was generated using methods similar to D1322. Data related to flash point was generated using methods similar to D93 and/or D6450. Data related to cetane number was generated using methods similar to D613. Data related to derived cetane number was generated using methods similar to D6890. Data related to cetane index was generated using methods similar to D4737 procedure A. Data related to net heat of combustion was generated using methods similar to D3338. Data related to volumetric heating value was generated through conversion of net heat of combustion using the density of the sample. Data related to FAME content was generated using methods similar to EN 14078. Data related to ester content was generated using methods similar to EN 14103.

The data and other measured values for the shale crude oils and shale oil fractions were then incorporated into an existing data library of other representative conventional and non-conventional crude oils for use in an empirical model. The empirical model was used to provide predictions for compositional characteristics and properties for some additional shale oil fractions that were not directly characterized experimentally. In this discussion, data values provided by this empirical model will be described as modeled data. In this discussion, data values that are not otherwise labeled as modeled data correspond to measured values and/or values that can be directly derived from measured values. An example of such an empirical model is AVEVA Spiral Suite 2019.3 Assay by AVEVA Solutions Limited.

FIGS. 1 and 2 show examples of the unexpected combinations of properties for shale crude oils that have a high weight ratio and/or volume ratio of naphthenes to aromatics. In FIG. 1, both the weight ratio and the volume ratio of naphthenes to aromatics is shown for 53 shale crude oils relative to the weight/volume percentage of aromatics in the shale crude oil. The top plot in FIG. 1 shows the volume ratio of naphthenes to aromatics, while the bottom plot shows the weight ratio. A plurality of other representative conventional crudes are also shown in FIG. 1 for comparison. As shown in FIG. 1, the selected shale crude oils described herein have an aromatics content of less than 21.2 vol % while also having a volume ratio of naphthenes to aromatics of 1.7 or more. Similarly, as shown in FIG. 1, the selected shale crude oils described herein have an aromatics content of less than 24.7 wt % while also having a weight ratio of naphthenes to aromatics of 1.5 or more. By contrast, none of the conventional crude oils shown in FIG. 1 have a similar combination of aromatics content of less than 21.2 vol % and a volume ratio of naphthenes to aromatics of 1.7 or more, or a combination of aromatics content of less than 24.7 wt % and a weight ratio of naphthenes to aromatics of 1.5 or more. It has been discovered that this unexpected combination of naphthenes to aromatics ratio and aromatics content is present throughout various fractions that can be derived from such selected shale crude oils.

In FIG. 2, both the volume ratio and weight ratio of naphthenes to aromatics is shown for the 53 shale crude oils in FIG. 1 relative to the weight of sulfur in the crude. The top plot in FIG. 2 shows the volume ratio of naphthenes to aromatics, while the bottom plot shows the weight ratio. The plurality of other representative conventional crude oils are also shown for comparison. As shown in FIG. 2, the selected shale crude oils described herein have a sulfur level of less than 0.1 wt % while also having a volume ratio of naphthenes to aromatics of 1.7 or more. Similarly, as shown in FIG. 2, the selected shale crude oils described herein have a sulfur level of less than 0.1 wt % while also having a weight ratio of naphthenes to aromatics of 1.5 or more. By contrast, none of the conventional crude oils shown in FIG. 2 have a similar combination of a sulfur level of less than 0.1 wt % while also having a volume ratio of naphthenes to aromatics of 1.7 or more, or a sulfur level of less than 0.1 wt % while also having a weight ratio of naphthenes to aromatics of 1.5 or more. Additionally, the selected shale crude oils have a sulfur content of roughly 0.1 wt % or less, while all of the conventional crude oils shown in FIG. 2 have a sulfur content of greater than 0.2 wt %. It has been discovered that this unexpected combination of high naphthene to aromatics ratio and low sulfur is present within various fractions that can be derived from such selected crude oils. This unexpected combination of properties contributes to the ability to produce low carbon intensity fuels from shale oil fractions and/or blends of shale oil fractions derived from the shale crude oils.

Characterization of Shale Oil Fractions—Distillate/Diesel Boiling Range Straight Run Fractions In various aspects, distillate boiling range fractions and/or diesel boiling range fractions as described herein can be used as a fuel fraction, such as a heating fuel fraction, a marine fuel fraction, or a diesel fuel fraction. The combination of low sulfur, high naphthenes to aromatics ratio, and low but substantial aromatics content can allow a distillate/diesel fraction to be used as a fuel fraction with a reduced or minimized amount of refinery processing.

FIG. 3 shows modeled values (from the empirical model described above) for 53 selected high naphthene to aromatic ratio distillate fractions based on the 53 different shale crude oils and/or shale crude oil blends shown in FIG. 1 and FIG. 2. For comparison, FIG. 3 shows modeled values for distillate fractions from nine conventional crude oils, as well as measured values for one ultra low sulfur diesel fuel. The model distillate fractions in FIG. 3 correspond to straight run fractions with an initial boiling point of 166° C. and a final boiling point of 352° C. The ultra low sulfur diesel was derived from a conventional crude diesel fraction, and therefore has been severely hydrotreated to achieve a sulfur content of 10 wppm or less. Also for comparison, FIG. 3 includes selected specification limits from an automotive diesel fuel specification (ASTM D975 Diesel No. 2 S15), a heating fuel specification (ASTM D396 Fuel Oil No. 2 S500), and a marine fuel specification (ISO 8217 DMA, ECA Sulfur Level) with a limit on sulfur content at the level that is permitted in Emission Control Areas (ECAs), which is a maximum of 0.1 wt %.

As shown in FIG. 3, the modeled high naphthene to aromatic ratio shale distillate fractions had a naphthenes content between roughly 21 wt % to 54 wt %, or 30 wt % to 54 wt %, or 40 wt % to 52 wt %, or 42 wt % to 50 wt %. As shown in FIG. 3, the modeled high naphthene to aromatic ratio shale distillate fractions in FIG. 3 also had an aromatics content between roughly 5.0 wt % to 20 wt %, or 6.0 wt % to 18 wt %, or 5.0 wt % to 17 wt %, or 6.0 wt % to 12 wt %, or 5.0 wt % to 12 wt %, or 6.0 wt % to 10 wt %. For such high naphthene to aromatic ratio shale distillate fractions, the weight ratio of naphthenes to aromatics can range from 2.5 to 10, or 2.5 to 8.5, or 2.5 to 7.7, or 2.7 to 8.5. The saturates content ranged from roughly 82 wt % to 94 wt %. Some of the high naphthene to aromatic ratio distillate fractions had an unexpected combination of high naphthenes to aromatics weight ratio and a low but substantial content of aromatics. For such fractions, the aromatics content was 5.0 wt % to 12 wt %, or 6.0 wt % to 11 wt %. For such fractions, the naphthenes to aromatics weight ratio was 2.8 to 10, or 3.2 to 10, or 3.5 to 10, or 4.0 to 10. The modeled high naphthene to aromatic ratio shale fractions in FIG. 3 are in contrast to the modeled conventional distillate fractions in FIG. 3. For example, the modeled conventional distillate fractions (and the measured ULSD) in FIG. 3 all have a saturates content of less than 82 wt % and naphthenes to aromatics ratios that are 2.2 or less. It is noted that the ULSD composition shown in FIG. 3 is in volume percent, rather than weight percent. For the distillate boiling range, the difference between values in vol % and values in wt % for the various compound classes is on the order of 1%.

Additionally, the modeled high naphthene to aromatic ratio shale distillate fractions shown in FIG. 3 had a density at 15° C. between 786 and 831 kg/m$^3$; a kinematic viscosity at 40° C. between 1.7 cSt and 2.4 cSt; a cetane index of roughly 49 to 61; and a sulfur content between 50 wppm and 485 wppm. The modeled high naphthene to aromatic ratio shale distillate fractions had a T10 distillation point of 185° C. to 205° C. and a T90 distillation point of 257° C. to 315° C.

FIG. 3 also shows a ratio of cetane index to weight percent of aromatics for the 53 modeled shale distillate fractions versus the conventional (mineral) distillate fractions. As shown in FIG. 3, because of the high cetane index and low but substantial aromatics content for the 53 modeled shale distillate fractions, the 53 modeled shale distillate fractions all have a ratio of cetane index to weight percent of aromatics of 2.8 or more. This is in contrast to the conventional fractions, where the ratio of cetane index to weight percent of aromatics is 2.8 or less.

Based on the modeled properties, specifically the modeled sulfur content, the modeled high naphthene to aromatic ratio shale distillate fractions in FIG. 3 can potentially be used as distillate heating fuel or a marine fuel without exposing the distillate fraction to hydroprocessing conditions. Based on this reduced or minimized refinery processing, a distillate heating fuel or marine fuel formed based on the modeled shale distillate fractions in FIG. 3 can have a reduced carbon intensity relative to a conventional distillate heating fuel or marine fuel.

In the values shown in FIG. 3, the 53 modeled shale distillate fractions had a naphthenes to aromatics weight ratio of 2.5 or higher, while the conventional (mineral) distillate fractions all had a naphthenes to aromatics ratio of 2.2 or less. Additionally, the 53 modeled shale distillate fractions all had a saturates content of 82 wt % or more, a sulfur content of 500 wppm or less, and an aromatics content of 4.5 wt % to 18 wt %, and a cetane index of 45 or more. As shown in FIG. 3, the 53 modeled shale distillate fractions also had a variety of properties that generally differed from the properties of conventional distillate fractions, such as T90 distillation point, kinematic viscosity at 40° C., and density at 15° C.

It is noted that while all of the 53 modeled shale fractions shown in FIG. 3 included a set of common features including a naphthenes to aromatics weight ratio of 2.5 or more, a saturates content of 82 wt % or more, an aromatics content of 18 wt % or less, and a sulfur content of 500 wppm or less, other shale fractions have been discovered that include less than all of these features. FIG. 4 shows a comparison of 15 additional modeled shale fractions that differ from the 53 modeled shale distillate fractions in FIG. 3 based on one or more of naphthenes to aromatics weight ratio, saturates content, aromatics content, cetane index, and/or sulfur content. The 15 additional modeled shale fractions are shown in the middle column of FIG. 4. For the 15 additional modeled shale fractions, each of the fractions have at least one of the following properties: a naphthenes to aromatics ratio of less than 2.5; a saturates content of less than 82 wt %; an aromatics content of greater than 18 wt %; and/or a sulfur content of greater than 500 wppm.

As shown in FIG. 4, the 15 modeled additional shale fractions that have been discovered can have some properties that overlap with the 53 modeled distillate shale fractions from FIG. 3. However, it can also be seen that because the 15 modeled additional shale fractions do not have the combination of a naphthenes to aromatics ratio of 2.5 or more, a saturates content of 82 wt % or more, an aromatics content of 18 wt % or less, and a sulfur content of 500 wppm or less, the resulting average properties for the 15 modeled additional shale fractions generally differ from the 53 modeled shale distillate fractions. For example, the 15 modeled additional shale fractions all have T90 distillation points of 310° C. or more, near the top end of range shown for the 53 modeled shale distillate fractions in FIG. 3. Additionally, the 15 modeled additional shale fractions have density values at 15° C. toward the higher end (0.81 g/cm$^3$ to 0.84 g/cm$^3$), and values for kinematic viscosity at 40° C. toward the higher end (2.1 cSt to 2.5 cSt).

In addition to full range diesel fractions, heavy diesel fractions derived from high naphthene to aromatics ratio shale crude oils can also have unexpected combinations of properties. FIG. 5 shows properties and/or features for modeled heavy diesel shale fractions. The first column in FIG. 5 shows values for a group of modeled heavy diesel shale fractions that have an unexpected combination of properties. In particular, all of the modeled heavy diesel shale fractions shown in the first column of FIG. 5 have a combination of a T90 distillation point of 360° C. or less, a cetane index of 45 or more, a naphthenes to aromatics weight ratio of 2.5 or more, an aromatics content of 4.5 wt % to 20 wt %, and a sulfur content of 1000 wppm or less. The second column shows values for additional modeled heavy diesel shale fractions that do not have at least one of the properties that is common to all of the modeled heavy diesel shale fractions shown in the first column. Thus, the modeled heavy diesel shale fractions in the second column have at least one of the following properties: a naphthenes to aromatics weight ratio of less than 2.5 an aromatics content of greater than 20 wt % (or greater than 25 wt %), or a sulfur content of greater than 1000 wppm.

In addition the above properties, the modeled heavy diesel shale fractions in the first column of FIG. 5 also have a T10 distillation point of 285° C. or higher; a T90 distillation point of 360° C. or lower, or 345° C. or lower; a density at 15° C. of 0.82 g/cm$^3$ to 0.86 g/cm$^3$; a kinematic viscosity at 40° C. of 3.0 cSt to 7.0 cSt, or 3.5 cSt to 6.5 cSt; a cetane index of 58-80, or 60-77; an aliphatic sulfur to total sulfur ratio of 0.15 or more; a nitrogen content of 1 wppm to 200 wppm; a basic nitrogen to total nitrogen ratio of 0.12 or more; a naphthenes to aromatics ratio of 2.5 to 13; a saturates content of 76 wt % or more, or 79 wt % or more; and a cetane index to weight percent of aromatics ratio of 3.0 to 20, or 3.1 to 16.

FIG. 5 also provides a comparison with modeled values for heavy diesel fractions based on the 9 comparative mineral diesel fractions shown in FIG. 3.

It is noted that in FIG. 5, the first column shows properties for 56 modeled heavy diesel fractions. The 56 modeled heavy diesel fractions include heavy diesel fractions based on the same shale crude oils and/or crude oil blends used for modeling the 53 distillate fractions shown in FIG. 3. Additionally, 3 heavy diesel fractions based on the 15 additional shale crude oils and/or crude oil blends from FIG. 4 also fell within the described combination of properties. Thus, in FIG. 5, the first column corresponds to 56 modeled heavy diesel shale fractions, while the second column corresponds to 12 additional modeled heavy diesel fractions (instead of the 53 and 15, respectively, in FIG. 4.)

In addition to the modeled values shown in FIG. 3, FIG. 4, and FIG. 5, diesel boiling range fractions from three different shale crudes and/or crude oil blends were characterized using a variety of techniques. FIG. 6 shows the measured values for the three shale diesel boiling range fractions.

In FIG. 6, the diesel boiling range fractions correspond to diesel fractions that were distilled from shale crudes and/or shale crude oil blends. The T10, T50, and T90 values shown in FIG. 6 were determined according to ASTM D86, but are believed to be roughly comparable to the values that would be produced by ASTM D2887. As shown in FIG. 6, the diesel fractions had a measured T10 distillation point of 250° C. or higher, or 260° C. or higher, or 270° C. or higher. The diesel fractions had a measured T90 distillation point of 360° C. or less, or 350° C. or less, or 345° C. or less. Based on the boiling ranges, the diesel samples shown in FIG. 6 are roughly similar in boiling range to the heavy diesel samples shown in FIG. 5.

It is noted that the diesel sample shown in the first column of FIG. 6 has an aromatics content of greater than 25 wt % while also having a naphthenes to aromatics ratio of less than 2.0. The saturates content is also less than 78 wt %. Based on this, the diesel sample in column I is an example of diesel fraction that would be grouped with the 12 additional modeled heavy diesel fractions shown in the middle column of FIG. 5 and/or with the 15 additional modeled diesel fractions in FIG. 4. It is further noted that the ratio of cetane index to weight percent of aromatics for the diesel in the first column of FIG. 6 is well below 2.8. Thus, the diesel sample in the first column of FIG. 6 represents a diesel sample that has been discovered, but that has properties different from the high naphthene to aromatics ratio and low but substantial aromatics content fractions described herein.

The diesel samples in the second and third columns of FIG. 6 correspond to diesel t0 samples that would be grouped with the 56 modeled heavy diesel shale fractions in FIG. 5 and/or with the 53 modeled diesel fractions in. FIG. 3. The samples in columns 2 and 3 of FIG. 6 have a naphthenes to aromatics ratio of 2.5 or more; a sulfur content of 500 wppm or less, a saturates content of 82 wt % or more; a cetane index of 45 or more (or 55 or more, or 60 or more); a naphthenes content of 40 wt % or more; an aromatics content of 20 wt % or less, or 18 wt % or less; and a ratio of cetane index of weight percent of aromatics of 2.8 or more (or 3.5 or more, or 4.0 or more). It is noted that FIG. 6 provides a ratio of aliphatic sulfur to non-aliphatic sulfur, as opposed to aliphatic sulfur to total sulfur, which is why the ratio can be greater than 1.0 in FIG. 6. The aliphatic sulfur to total sulfur ratio for the diesel fractions in columns 2 and 3 would be between 0.15 and 0.8.

The samples shown in FIG. 6 were also characterized for various additional properties, such as cold flow properties. As shown in FIG. 6, the diesel fractions in columns 2 and 3 had a hydrogen content of 13.5 wt % or more; a cloud point of 0° C. or less; a pour point of −5° C. or less; a cold filter plugging point (CFPP) of −5° C. or less; and a kinematic viscosity at 40° C. of 4.0 cSt to 5.0 cSt.

As a further comparison for the data in FIG. 3, FIG. 4, FIG. 5, and FIG. 6, an article titled "Impact of Light Tight Oils on Distillate Hydrotreater Operation" in the May 2016 issue of Petroleum Technology Quarterly included a listing of paraffin and aromatics contents for straight run diesel fractions derived from shale oils from a variety of shale oil formations. Comparative Table 1 shows the data provided from that article. The cut point for the straight run fractions is described as being between 260° C. and 343° C. Comparative Table 1 also includes a column for a representative straight run diesel fraction derived from West Texas Intermediate, a conventional light sweet crude oil. It is noted that the representative sulfur content reported in the article for WT1 was greater than 2000 wppm.

In Comparative Table 1, the values for paraffins and aromatics correspond to wt % as reported in the article. The naphthenes value is a maximum potential value calculated based on the reported paraffins and aromatics values. (The actual naphthenes value could be lower due to the presence of polar compounds.) This naphthenes weight percent was then used to calculate the naphthenes to aromatics ratio shown in the final row of the table.

COMPARATIVE TABLE 1

| | Comparative Diesel Fractions | | | | | | | |
|---|---|---|---|---|---|---|---|---|
| | WTI | Bakken | Eagle Ford | Bach Ho | Cossack | Gippsland | Kutubu | Qua Iboe |
| Paraffins | 35 | 29 | 42 | 46 | 40 | 49 | 31 | 27 |
| Aromatics | 20 | 24 | 17 | 16 | 23 | 24 | 28 | 23 |
| Naphthenes (calculated, maximum potential) | 45 | 47 | 41 | 38 | 37 | 37 | 41 | 50 |
| Naphthenes to Aromatics ratio | 2.3 | 2.0 | 2.4 | 2.4 | 1.6 | 1.6 | 1.5 | 2.2 |

As shown in Comparative Table 1, the highest naphthenes to aromatics ratio shown is 2.4. All of the fractions in Comparative Table 1 had an aromatics content of 16 wt % or more. This further illustrates the unexpected nature of the properties of the selected high naphthene to aromatic ratio straight run distillate fractions described herein, which have a naphthenes to aromatics ratio of 2.5 or more (or 2.6 or more, or 2.8 or more, or 3.2 or more) and an aromatics content of 4.5 wt % to 25 wt %, or 4.5 wt % to 18 wt %, or 5.0 wt % to 18 wt %, or 5.0 wt % to 16 wt %, or 5.0 wt % to 12 wt %, or 5.0 wt % to 10 wt %.

Characterization of Shale Oil Fractions—Hydrotreated Diesel Boiling Range Fractions In order to form ultra low sulfur diesel (ULSD) for use as an automotive fuel, a diesel boiling range fraction from a selected shale oil crude as described herein can be hydrotreated. The hydrotreatment can occur prior to fractionation to form the diesel boiling range fraction, after passing through a fractionator, or a combination thereof. Due to the low initial sulfur content of the straight run diesel boiling range fractions described herein, a low severity hydrotreatment process can be used for form a diesel fraction having a sulfur content of 10 wppm or less. As a result, aromatics can be preserved during the hydrotreatment, leading to ultra low sulfur diesel compositions that include a low but substantial content of aromatics, such as 5.0 wt % to 25 wt %, or possibly higher.

FIG. 7 shows measured compositional values and properties for hydrotreated diesel boiling range fractions derived from selected shale crude oils, as described herein. It is noted that the targeted cut point for the hydrotreated diesel fractions in FIG. 7 was 370° C. This is in contrast to the 350° C. final boiling point for the modeled distillate fractions shown in FIG. 3. This increase in boiling range can also be seen in the T90 distillation points. The measured T90 distillation points for the diesel fractions in FIG. 7 are between 347° C. and 371° C., indicating that some components with a boiling point greater than 370° C. may be present in some of the diesel fractions. For the modeled distillate fractions in FIG. 3, the T90 distillation points were roughly 40° C. lower. Due to the higher boiling range for the diesel fractions in FIG. 7, the aromatics content is higher than the distillate fractions shown in FIG. 3.

The composition and properties for several types of hydrotreated shale diesel fractions are shown in FIG. 7. The first two columns correspond to heavy diesel fractions, with TI 0 distillation points of 290° C. or higher and T90 distillation points of 350° C. to 371° C. This is higher than the T90 distillation point specification for some types of diesel fuels, so an additional fractionation or blending would be required for direct use as certain types of diesel fuels. The remaining three columns have lower T10 distillation points between 190° C. and 200° C., but the T90 distillation points are still between 340° C. and 350° C. These correspond to full range diesel fractions, but again some fractionation to remove the top end of the boiling range would be necessary to meet some diesel specifications. All of the hydrotreated diesel fractions shown in FIG. 7 have a sulfur content of 10 wppm or less, or 5.0 wppm or less.

As shown in FIG. 7, the heavy diesel fractions had a naphthenes content between 35 wt % to 40 wt %, while the full range diesel fractions had a naphthenes content between 35 wt % to 48 wt %. The heavy diesel fractions had an aromatics content between 18 wt % to 25 wt %, while the full range diesel fractions had an aromatics content between 4.5 wt % to 25 wt %, or 5.0 wt % to 25 wt %, or 10 wt % to 25 wt %, or 10 wt % to 20 wt %, or 10 wt % to 16 wt %, or 4.5 wt % to 16 wt %, or 5.0 wt % to 16 wt %. For the heavy diesel fractions, the weight ratio of naphthenes to aromatics ranged from 1.7 to 2.0, while the saturates content was roughly 78 wt % to 82 wt %. The full range diesel fractions had a weight ratio of naphthenes to aromatics of 1.6 or more, or 2.6 or more, such as up to 10, while the saturates content ranged from 75 wt % to 85 wt %. Some of the full range diesel fractions had an unexpected combination of high naphthenes to aromatics weight ratio and a low but substantial content of aromatics. For such fractions, the aromatics content was 4.5 wt % to 16 wt %, or 5.0 wt % to 16 wt %, 4.5 wt % to 12 wt %, or 5.0 wt % to 12 wt %, or 10 wt % to 16 wt %. For such fractions, the naphthenes to aromatics ratio was 2.6 or more, or 2.9 or more, or 3.2 or more, such as up to 10.

Additionally, the heavy diesel fractions shown in FIG. 7 had a density at 15° C. between 830 and 840 kg/m$^3$; a pour point between 0° C. and 5.0° C.; a cloud point between 5.0° C. and 10° C.; a freeze point between 7.5° C. and 8.5° C. a nitrogen content of 1.0 wppm or less; a cetane index between 70 to 77, or between 70 to 75; and a ratio of cetane index to weight percent of aromatics between 2 to 6, or between 2.5 to 5.

Additionally, the full range diesel fractions shown in FIG. 7 had a density at 15° C. between 810 and 820 kg/m$^3$, a pour point between −10° C. and −25° C.; a cloud point between 0° C. and −15° C.; a freeze point between −1.0° C. and −11° C.; a nitrogen content of 1.0 wppm or less; a cetane index between 55 to 60; and a ratio of cetane index to weight percent of aromatics between 2 to 5, or between 3 to 4.

In addition to the values shown in FIG. 7, measured values for a hydrotreated heavy fraction were generated by hydrotreating the heavy diesel fraction shown in the first column of FIG. 6. Although the heavy diesel fraction shown in the first column of FIG. 6 had an aromatics content that was slightly above 25 wt % (and therefore a naphthenes to aromatics ratio below 2.5), hydrotreatment of that sample resulted in a hydrotreated heavy diesel that was comparable in properties to a hydrotreated heavy diesel shale fraction that initially had a higher naphthenes to aromatics ratio. As shown in the first column of FIG. 11, in addition to including less than 10 wppm of sulfur, the resulting hydrotreated diesel had a naphthenes to aromatics ratio of 4.0 or more and a ratio of cetane index to weight percent of aromatics of 5.0 or more.

The measured hydrotreated diesel compositions and properties shown in FIG. 7 and FIG. 11 can be compared with the conventional ultra low sulfur diesel shown in FIG. 3. As shown in FIG. 3, the conventional ultra low sulfur diesel had a naphthenes to aromatics ratio of less than 1.0. This is due in part to the conventional ultra low sulfur diesel having an aromatics content of 25 wt % or more. Additionally, the conventional ultra low sulfur diesel has a saturates content of less than 75 wt %. By contrast, the hydrotreated diesel fractions shown in FIG. 7 and the first column of FIG. 11 have a saturates content of 75 wt % or more, or 80 wt % or more (and a corresponding aromatics content of less than 25 wt %, or less than 20 wt %).

Characterization of Shale Oil Fractions—Further Processing of Diesel Boiling Range Fractions For hydrotreated diesel fractions with a high naphthenes to aromatics ratio and an aromatics content of greater than 10 wt %, it may be desirable to perform further processing in addition to hydrotreatment when forming a diesel fuel (or fuel blending component). One option can be to start with a diesel fraction having a naphthenes to aromatics weight ratio of 1.6 or more (or 2.6 or more) and a combined amount of naphthenes and aromatics of 50 wt % to 65 wt %, and then perform aromatic saturation to convert a portion of the aromatics to naphthenes. This can reduce the aromatics concentration in the resulting diesel fraction to between 4.5 wt % to 10 wt %, or 5.0 wt % to 10 wt %. This reduction in aromatics concentration can provide both an increase in the naphthenes content and an increase in the corresponding naphthenes to aromatics weight ratio. After performing limited aromatic saturation on a full range diesel fraction, an aromatic saturated, hydrotreated diesel boiling range fraction can be formed with an aromatics content of 4.5 wt % to 10 wt %, or 5.0 wt % to 10 wt %, a naphthenes content of 40 wt % to 60 wt %, and a naphthenes to aromatics ratio of 4.0 to 10, or 4.0 to 8.0, or 5.0 to 10, or 5.0 to 8.0. In addition to having an increased naphthenes to aromatics ratio, the resulting diesel boiling range fraction can also have a reduced density and an increased cetane index. For example, the density of a hydrotreated, aromatic saturated full range diesel boiling range fraction can be between 805 kg/m$^3$ to 832 kg/m$^3$, or 805 kg/m$^3$ to 820 kg/m$^3$, or 805 kg/m$^3$ to 815 kg/m$^3$, while the cetane index can be between 57 to 61, and the ratio of cetane index to weight percent of aromatics can be 4 to 15, or 5 to 13. For a hydrotreated, aromatic saturated heavy diesel, the density can be between 820 kg/m$^3$ to 830 kg/m$^3$ and/or the cetane index can be 75 to 80, and the ratio of cetane index to weight percent of aromatics can be 8 to 15.

FIG. 8 shows measured values for diesel boiling range fractions that were exposed to hydrotreatment conditions followed by aromatic saturation conditions. To generate the measured values in FIG. 8, products Diesel 2, Diesel 3, and Diesel 4 from FIG. 7 were used as feeds for exposure to aromatic saturation conditions. This resulted in products Diesel 2A, Diesel 3A, and Diesel 4A as shown in FIG. 8.

For FIG. 8, the aromatic saturation conditions that were used were sufficient to reduce the aromatics content to substantially zero. As shown in FIG. 8, this was achieved with little or no corresponding ring opening. For example, the cyclic hydrocarbons (combined naphthenes plus aromatics) in Diesel 2 (FIG. 7, after hydrotreatment) was 56.93 wt %. After exposing Diesel 2 to aromatic saturation conditions to remove substantially all aromatics, the resulting naphthenes content in Diesel 2A was 54.83 wt %. Thus, only about 2.0 wt % of the aromatics were converted to paraffins by ring opening, as opposed to conversion to naphthenes by aromatic saturation. Similarly, the combined naphthenes and aromatics for Diesel 3 was 59.37 wt %, while the naphthenes content of Diesel 3A was 57.31 wt %. The combined naphthenes and aromatics for Diesel 4 was 59.84 wt %, while the naphthenes content of Diesel 4A was 57.40 wt %.

Based on the results shown in FIG. 8, it has been discovered that for diesel fractions formed from the selected crude oils, aromatic saturation can be performed to convert aromatics to naphthenes while causing only a reduced or minimized amount of ring opening. As shown in FIG. 8, the amount of conversion of aromatics to paraffins corresponded to causing roughly 3.0 wt % or less of the aromatics in the diesel fraction. This ability to use aromatic saturation to convert aromatics to naphthenes with reduced or minimized ring opening can therefore be used to create desirable compositions having a high naphthenes to aromatics ratio while also having a low but substantial aromatics content. For example, an initial diesel hydrotreated boiling range fraction can be selected that has a sulfur content of 10 wppm or less, a naphthenes to aromatics ratio of 2.6 or more, an aromatics content of 10 wt % or more, and a combined amount of naphthenes plus aromatics (cyclic hydrocarbons) of 45 wt % or more (or 50 wt % or more, or 55 wt % or more, such as up to 65 wt %) relative to the weight of the fraction. For such a fraction, an aromatic saturation process can be used to reduce the aromatics content to between 5.0 wt % and 10 wt % while reducing the combined content of naphthenes plus aromatics by 3.0 wt % or less. This can allow for production of hydrotreated, aromatic saturated diesel boiling range fractions with a naphthenes content of 35 wt % or more, or 40 wt % or more, such as up to 55 wt %, and a naphthenes to aromatics weight ratio of 4.0 or more or 5.0 or more, such as up to 11.

It is noted that Diesel 2A, Diesel 3A, and Diesel 4A in FIG. 8 also had favorable combinations of other properties. The other properties included a density at 15° C. between 800 and 830 kg/n·0; a nitrogen content of 1.0 wppm or less; and a cetane index between 70 to 80 for Diesel 2A, or between 57 to 65 for Diesel 3A and 4A. Additionally, Diesel 3A and Diesel 4A had a cloud point between 0° C. and −10° C.

Another option can be to perform a ring opening process on a diesel fraction. A ring opening process can be used to form a diesel boiling range fraction with an aromatics content of 5.0 wt % to 10 wt %, a naphthenes content of 12 wt % to 35 wt %, or 15 wt % to 35 wt %, or 20 wt % to 35 wt %, or 25 wt % to 35 wt %, or 12 wt % to 28 wt %, and a naphthenes to aromatics weight ratio of 1.8 to 7.0, or 2.2 to 7.0, or 2.6 to 7.0, or 3.0 to 7.0, or 1.8 to 5.0, or 1.8 to 3.0.

FIG. 9 shows examples of modeled composition and properties for diesel fractions having an aromatics content of 5.0 wt % to 10 wt %, a naphthenes content of 12 wt % to 35 wt %, and a naphthenes to aromatics ratio of 1.8 to 7.0. Diesel 6 and Diesel 7 correspond to full boiling range diesel fractions, while Diesel 8 and Diesel 9 correspond to heavy diesel fractions. The heavy diesel fractions corresponding to Diesel 8 and Diesel 9 have naphthenes contents of 12 wt % to 25 wt %, with a naphthenes to aromatics ratio of 1.8 to 2.5. For Diesel 6 and Diesel 7, the naphthenes content is between 25 wt % and 35 wt %, with a corresponding higher naphthenes to aromatics weight ratio of 2.4 to 5.0 Due to hydrotreatment prior to aromatic saturation and ring opening, the sulfur and nitrogen contents of the diesel fractions in FIG. 7 are less than 0.1 wppm.

As shown in FIG. 9, the heavy diesel fractions had an API gravity between 40 and 45; a density at 15° C. between 800 and 830 kg/m$^3$; a cloud point between 0° C. and 10° C.; a cetane index between 80 and 90; and a ratio of cetane index to weight percent of aromatics between 8 to 13. The full range diesel fractions had an API gravity between 46 and 50; a density at 15° C. between 780 and 800 kg/m$^3$; a cloud point between −5° C. and −15° C.; a cetane index between 60 to 65; and a ratio of cetane index to weight percent of aromatics between 6 to 10.

Yet another option can be to perform catalytic dewaxing on a fraction exposed to hydrotreatment, aromatic saturation, and/or ring opening. In addition to the above properties for a diesel boiling range fraction exposed to a ring opening process, a dewaxed fraction can have a cloud point of 0° C. to −20° C. A dewaxed fraction not exposed to a ring opening process can have a still lower cloud point of −5° C. to −30° C., or possibly still lower.

FIG. 11 shows additional examples of shale diesel boiling range fractions that were exposed to hydrotreatment and aromatic saturation or hydrotreatment, catalytic dewaxing, and aromatic saturation. Column 2 of FIG. 11 shows measured values for a sample formed by exposing the heavy diesel from the first column of FIG. 6 to hydrotreatment followed by aromatic saturation. Column 3 of FIG. 11 shows measured values for a sample formed by exposing the heavy diesel from the first column of FIG. 6 to hydrotreatment, catalytic dewaxing, and then aromatic saturation. Column 4 of FIG. 11 shows measured values for a sample formed by exposing the heavy diesel from the second column of FIG. 6 to hydrotreatment, catalytic dewaxing, and then aromatic saturation.

As shown in column 2 of FIG. 11, exposing a heavy diesel fraction to both hydrotreatment and aromatic saturation can allow for formation of a hydroprocessed product having a sulfur content of less than 10 wppm that also has an aromatics content of less than 10 wt %. Based on a comparison of column 1 and column 2, it appears that the additional aromatic saturation resulted in a substantial reduction in aromatics (from roughly 12.5 wt % to roughly 7.5 wt %), but a comparable amount of the cyclic ring structures in the sample were also opened, as the combined total of aromatics and naphthenes in the sample was substantially the same after performing the additional aromatic saturation process.

As shown in column 3 of FIG. 11, addition of catalytic dewaxing to the processing did not have a major impact on the aromatics or naphthenes content relative to column 2, where only hydrotreatment and aromatic saturation processes were performed. However, addition of catalytic dewaxing did reduce the cloud point of the dewaxed sample to below −10° C. Column 4 of FIG. 11 shows that comparable results could be achieved by exposing the heavy diesel from the second column of FIG. 6 to a similar sequence of hydrotreatment, catalytic dewaxing, and aromatic saturation. It is further noted that all of the hydroprocessed samples in FIG. 11 had a variety of unexpected and beneficial characteristics, including a naphthenes to aromatics ratio of 4.0 or more; a saturates content of 82 wt % or more, or 85 wt % or more; an aromatics content of 15 wt % or less, or 10 wt % or less; a cetane index of 60 or higher, or 65 or higher; and a ratio of cetane index to weight percent of aromatics of 4.0 or more.

Additional Example 1

Comparison of High Naphthene to Aromatics Ratio. Low but Substantial Aromatics Content Fractions with Various Fractions Including Bio-Derived Content FIG. 12 shows a comparison of properties for a series of different types of diesel boiling range fractions. The "base diesel" column corresponds to a conventional ultra low sulfur diesel. The "B100 RME" column corresponds to a biodiesel (fatty acid methyl ester based) formed from rapeseed oil. The "B7" and "B20" columns correspond to blends of the base diesel with either 7 vol % of the B100 RME or 20 vol % of the B100 RME, respectively. The "HVO" column corresponds to hydrotreated vegetable oil.

In FIG. 12, Blend A and Blend B correspond to synthetically prepared blends that are designed to have properties comparable to hydrotreated samples of high naphthenes to aromatics ratio and low but substantial aromatics content shale diesel fractions. Blend A and Blend B were prepared based on the properties for the hydroprocessed fractions shown in FIGS. 7-11. The blends were formed by blending of various fractions and/or individual components. The blends were prepared in order to ensure that sufficient volumes of material would be available to allow for testing in an engine under vehicle emissions testing conditions. As shown in FIG. 12, Blend A and Blend B had a naphthenes to aromatics ratio of 4.0 or more; an aromatics content of 10 wt % or less (and therefore a saturates content of 90 wt % or more), but greater than 3.0 wt %; a sulfur content of 10 wppm or less; a cetane index of 60 or more; and a cetane index to weight percent of aromatics ratio of 2.8 or more, but less than 20. Thus, it is believed that Blend A and Blend B are representative of hydroprocessed fractions derived from shale diesel fractions with a high naphthenes to aromatics ratio and a low but substantial content of aromatics.

With regard to the values shown in FIG. 12, it is noted that the Cetane Number of 8100 RME is estimated based on average of B100 RME Cetane Numbers in *Energies* 2019, 12, 422 Table 4. The Cetane Number of the B7 and B20 blends are calculated as vol % weighted averages of the Cetane Number values for Base Diesel and B100 RME. Similarly, the kinematic viscosity and sulfur of the B7 and B20 blends are estimated based on Base Diesel and B100 RME quality assuming the blend reflects about a vol % weighted average. Additionally, the total and multi-ring aromatics content of B100 RME is estimated as "0" based on composition of neat B100 RME containing only mono-alkyl esters of a rapeseed oil. The total and multi-ring aromatics content of B7 and B20 blends are calculated as wt % weighted averages of the total and multi-ring aromatics content of Base Diesel and B100 RME.

As shown in FIG. 12, Blend A and Blend B are qualitatively different from the other types of fuels, based in part on the aromatics content. With regard to the base diesel and the blends with the base diesel (B7 and B20), the base diesel, B7, and 820 fuels all have an aromatics content of 24 wt % or higher, and therefore a corresponding low content of saturates. Due to the high content of aromatics, the base diesel, B7, and B20 fuels all have a ratio of cetane index to weight percent of aromatics that is below 2.8. The B100 RME and the HVO are also qualitatively different, but for the opposite reason. Due to the bio-derived nature of these fuels, the aromatics content approaches 0%. This results in a ratio of cetane index to weight percent of aromatics that is exceedingly large (>1000) or possibly even undefined.

Unexpectedly, the qualitative difference in the different fuels shown in FIG. 12 also results in a difference in volumetric heat content. As shown in FIG. 12, the volumetric heating value for Blend A and Blend B is 36.1 MJ/liter or higher. By contrast, the volumetric heating value for all of the other fractions shown in FIG. 12 is 36.0 MJ/liter or less. It is noted that the volumetric heating value is substantially less for the fuels that are entirely composed of bio-derived materials. Without being bound by any particular theory, it is believed that the unexpectedly high volumetric heating value is due in part to Blend A and Blend B having a low but substantial content of aromatics while also having substantially no content of oxygen, as is found in some bio-derived fuels. For example, in the B7 and B20 fuels, adding in a portion of a FAME fraction resulted in a reduction in aromatics content, but at the expense of also adding oxygen-containing components to the fuel. This resulted in a noticeable decrease in volumetric heat capacity in exchange for the reduction in aromatics content. It is noted that the hydrotreated vegetable oil does not have a similar content of oxygen. However, due to the highly paraffinic nature of hydrotreated vegetable oil, the density of the hydrotreated vegetable oil is substantially lower than any of the other fuels shown in FIG. 11. This substantially lower density results in an overall lower volumetric heating value.

Additional Example 2

Vehicle Emissions Measurement on a Chassis Dynamometer and Fuel Consumption

The various fuels shown in FIG. 12 were used as fuels in an engine in order to perform various types of emissions measurements. The following definitions can assist with understanding the results from the vehicle emissions testing.

"Tailpipe emissions" are also called exhaust emissions. Tailpipe emissions are regulated by governments to reduce pollution from vehicles. Emissions include nitrogen oxides (NOx), particulate matter (PM), hydrocarbon (HC) and carbon monoxide (CO). CO2 is also regulated in recent years to reduce greenhouse gas emissions. Emission standards have different limits for different types of vehicles. Tailpipe emissions are often measured on a chassis dynamometer following a driving cycle with exhaust gas analyzed by different emission analyzers. Emission testing procedures are well defined as part of the emission regulation. New vehicles need to be certified to certain emission standards. Euro 6 has been the standard for light duty vehicles in the European Union since 2014.

"Engine-out emissions" are the emissions measured after engine and before any aftertreatment system. Engine-out emissions are typically too high to meet exhaust emission standards and an aftertreatment system is needed to convert or reduce the emissions. Even though there is no regulations on engine out emissions directly, lower engine-out emissions can reduce or minimize the burden on an aftertreatment system. Engine-out emissions can be measured at the same time with tailpipe emissions. Separate sampling systems and analyzers are needed in addition to the ones for tailpipe emissions.

"Fuel consumption" is a form of vehicle efficiency described based on a certain volume of fuel over a certain distance. In most countries, fuel consumption is stated as fuel consumed in liters per 100 kilometers. In some countries, fuel consumption is expressed in miles per gallon (mpg). Fuel consumption is often measured simultaneously during the emission testing following the same vehicle emission certification procedure.

Exhaust gases, also called emissions, are the mixture of various types of gaseous and microscopic particulate compounds formed as a byproduct of combustion of fuel in an engine or other combustion device, such as combustion of diesel fuel or marine fuel in a compression ignition (diesel) engine. An example of gaseous compounds created by fuel combustion are oxides of nitrogen, including NO and $NO_2$, which are collectively referred to as "NOx emissions," see US EPA Technical Bulletin "Nitrogen oxides (NOx), why and how they are controlled," EPA456/F-99-006R, November 1999.

To perform the emissions measurements, a Ford Ranger 3.2 TDCi with a 3.2L diesel engine was mounted on a chassis dynamometer to measure both engine out emissions and tailpipe emissions. The vehicle was certified for Euro 6 emissions standards with a Single Brake System (combined oxidation catalyst and DPF (Diesel Particulate Filter)) and a SCR (Selective Catalytic Reduction) catalyst. The emission testing followed Euro 6 (WLTP 2' Act) with WLTC as standard driving cycle. Horiba MEXA-7400HLE and Horiba CVS-7400S were the emission measuring system for standard bag diluted emissions. At the same time, Horiba MEXA-7100 EDGR system was used for raw emission measurement. The sampling point was pre-catalyst, thus it was a direct engine out emission measurement. CO, $CO_2$, NOx and hydrocarbons (HC) were measured by Horiba analyzers and fuel consumption was calculated based on carbon balance method following the standard procedure. Each measurement had minimum three repeats. The average of the emission results are shown in FIG. 13A. Additional analysis of the data shown in FIG. 13A is provided in FIG. 13B (Blend A) and FIG. 13C (Blend B).

Figure 14:
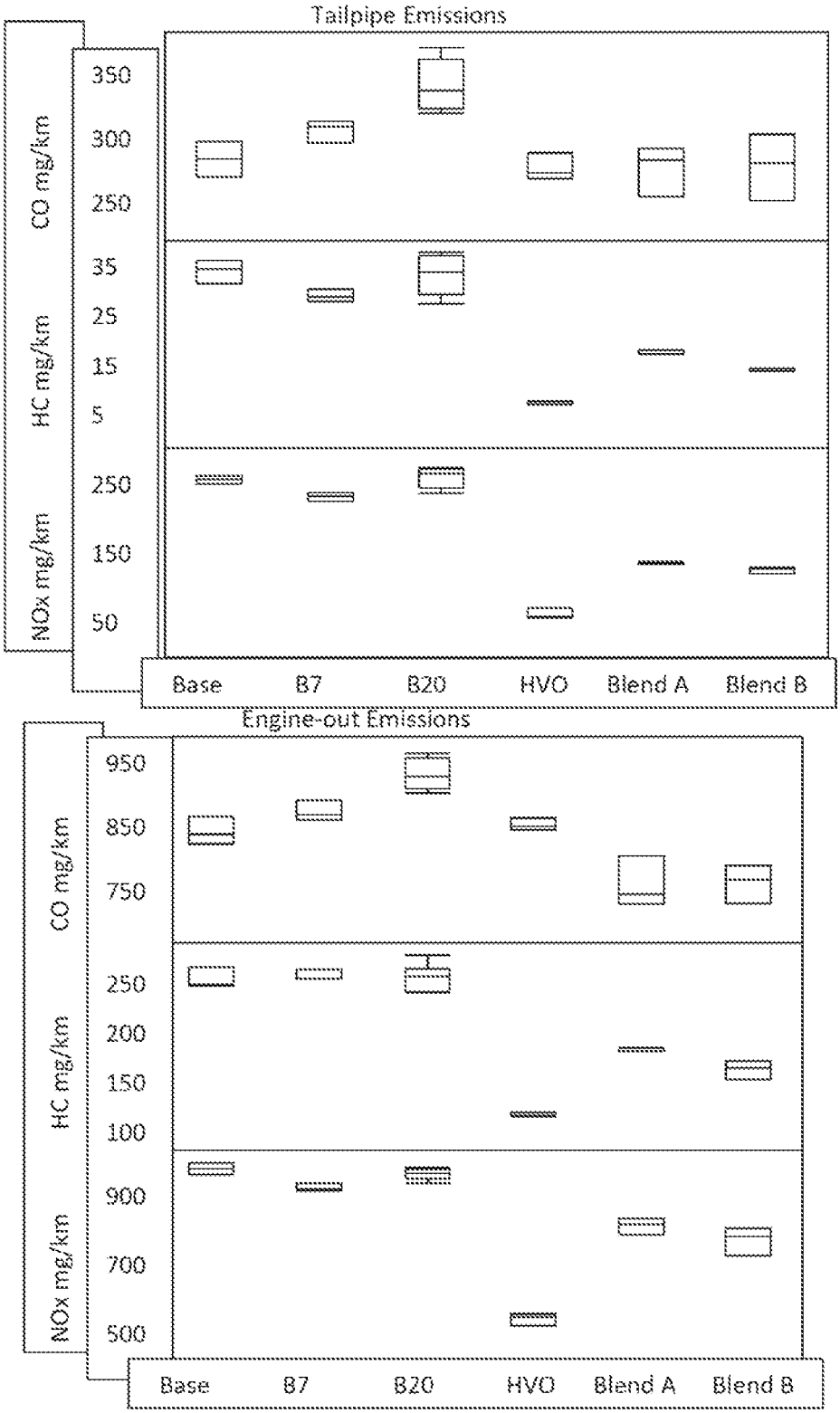
FIG. 14 shows measured engine-out and tailpipe emissions results from testing various diesel fuels in a vehicle driving on a chassis dynamometer.

As shown in FIG. 13A and FIG. 14, tailpipe emissions of Blend A and Blend B were equal or better than Base Diesel and B7 and B20 fuel. The NOx emissions of Blend A and Blend B were comparable with Base Diesel, but lower than B7 and B20. Blend A and Blend B had substantially lower hydrocarbon (HC) and CO emissions than Base Diesel, B7 and B20 fuels. Thus, at least 37% reductions of HC tailpipe emissions and 41% reduction of CO tailpipe emissions were been achieved by Blend A and Blend B relative to the base diesel, B7, and B20 fuels. With regard to HVO, the HVO fuel had the same level of NOx emissions, but lower HC and CO emissions at tailpipe than Blend A and Blend B.

Figure 15:
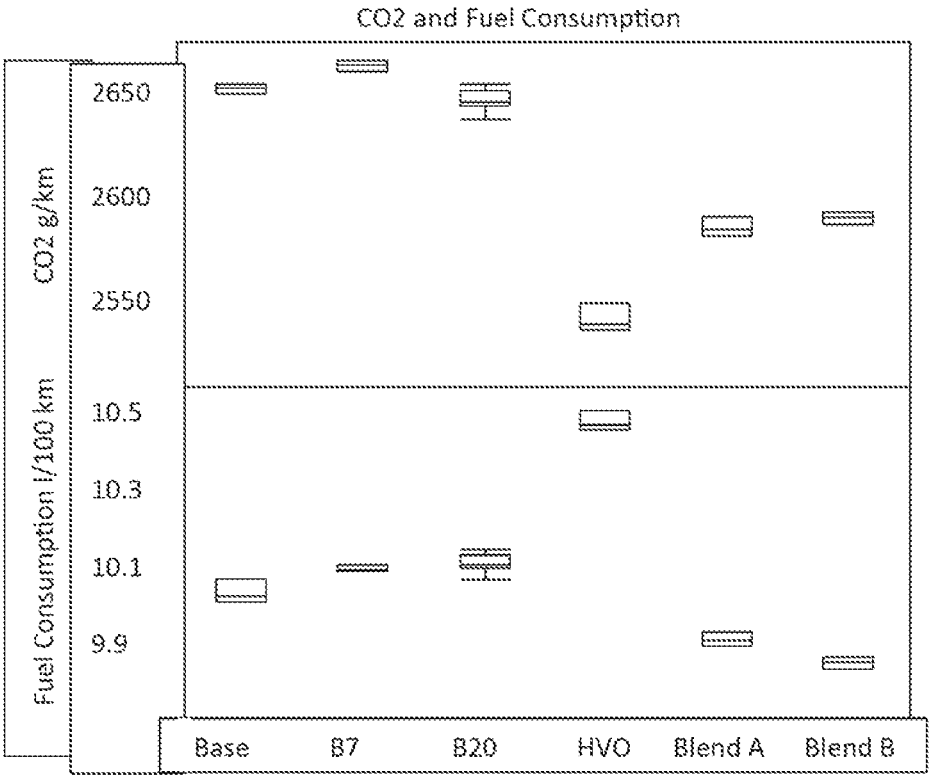
FIG. 15 shows measured $CO_2$ and fuel consumption results from testing various diesel fuels in a vehicle driving on a chassis dynamometer.

As shown in FIG. 13A and FIG. 15, Blend A and Blend B had at least 2.3% lower $CO_2$ emission than those of base diesel, B7 and B20. HVO has lower $CO_2$ emission than Blend A and Blend B.

As shown in FIG. 13A and FIG. 14, engine out emissions of Blend A and Blend B were lower than base diesel, B7 and B20 by at least 11% for NOx, 40% for HC and 11% for CO. The lower engine out NOx emissions should lead to lower Diesel Emission Fluid consumption, which is used to convert NOx with SCR catalyst. When compared with HVO for engine out emissions, Blend A and Blend B had lower NOx emissions, but higher HC and CO emissions.

As shown in FIG. 13B, FIG. 13C, and FIG. 15, Blend A and Blend B unexpectedly had at least 1.2% lower fuel consumption than Base Diesel, B7 and B20, while they further unexpectedly had 5.4% lower fuel consumption than HVO. The lower fuel consumption was the result of higher energy density by volume for Blend A and Blend B. Without being bound by any particular, theory, it is believed that based on the consideration that HVO, Blend A, and Blend B all had low aromatics content, the higher content of naphthenes in Blend A and Blend B allowed Blend A and Blend B to contain more energy than the normal- or iso-paraffins present in the HVO.

As shown in FIG. 12, Blend A and Blend B represent a qualitatively different type of fuel than conventional mineral and/or bio-derived fuels and fuel blends. As illustrated in FIG. 13A, FIG. 13B, FIG. 13C, FIG. 14, and FIG. 15, this qualitative difference in the fuel is believed to translate into reduced emissions and/or decreased fuel consumption when operating an engine.

In some aspects, by operating a vehicle using a diesel fuel with a high naphthene to aromatics ratio and low but substantial aromatics content, and which was subjected to additional processing (such as hydrotreatment, aromatic saturation, ring opening, catalytic dewaxing, or a combination thereof), vehicle fuel consumption (in terms of liters fuel consumed per 100 km driven) can be reduced by about 0.1% to 6.0% relative to a conventional diesel fuel, a blend of conventional diesel fuel and biodiesel, or a hydrotreated vegetable oil. For example, the fuel consumption can be reduced by 0.1% to 5.0%, 0.1% to 4.0%, 0.1% to 3.0%, or 0.1% to 2.0%, or 1.0% to 6.0%, or 2.0% to 6.0%, or 3.0% to 6.0%, or 4.0% to 6.0%, or by 6.0% or lower, or by 5.0% or lower, or by 4.0% or lower, or by 3.0% or lower, or by 2.0% or even lower, such as down to 0.1%. Additionally or alternately, the fuel consumption can be reduced relative to the fuel consumption for a fuel having an aromatics content of 25 wt % or greater or an aromatics content of 3.0 wt % or less.

In some aspects, by operating a diesel vehicle using a diesel fuel with a high naphthene to aromatics ratio and low but substantial aromatics content, and which was subjected to additional processing (such as hydrotreatment, aromatic saturation, ring opening, catalytic dewaxing, or a combination thereof), vehicle tailpipe $CO_2$ emissions (in terms of g $CO_2$ per km traveled) can be reduced by ~0.1% to ~3.0% relative to a conventional diesel fuel or a blend of conventional diesel fuel and biodiesel. For example, tailpipe $CO_2$ emissions can be reduced by 0.1 to 2.5%, or 0.5 to 3.0%, or 1.0 to 3.0%, or 2.0 to 3.0%. Additionally or alternately, the vehicle tailpipe $CO_2$ emissions can be reduced relative to the emissions for a fuel having an aromatics content of 25 wt % or greater.

In some aspects, by operating a diesel vehicle using a diesel fuel with a high naphthene to aromatics ratio and low but substantial aromatics content, and which was subjected to additional processing (such as hydrotreatment, aromatic saturation, ring opening, catalytic dewaxing, or a combination thereof), vehicle tailpipe CO emissions (in terms of mg CO per km traveled) can be reduced by about 2% to 53% relative to a conventional diesel fuel or a blend of conventional diesel fuel and biodiesel. For example, tailpipe CO emissions can be reduced by about 2 to 53%, or about 10 to 53%, or about 20 to 53%, or about 30 to 53%, or about 40 to 53%. Additionally or alternately, the vehicle tailpipe CO emissions can be reduced relative to the emissions for a fuel having an aromatics content of 25 wt % or greater.

In some aspects, by operating a diesel vehicle using a diesel fuel with a high naphthene to aromatics ratio and low but substantial aromatics content, and which was subjected to additional processing (such as hydrotreatment, aromatic saturation, ring opening, catalytic dewaxing, or a combination thereof), vehicle tailpipe HC emissions (in terms of mg HC per km traveled) can be reduced by about 1% to 55% relative to a conventional diesel fuel or a blend of conventional diesel fuel and biodiesel. For example, tailpipe HC emissions can be reduced by about 10 to 55%, or about 20 to 55%, or about 30 to 55%, or about 40 to 53%, or about 40 to 53%. Additionally or alternately, the vehicle tailpipe HC emissions can be reduced relative to the emissions for a fuel having an aromatics content of 25 wt % or greater.

In some aspects, by operating a diesel vehicle using a diesel fuel with a high naphthene to aromatics ratio and low but substantial aromatics content, and which was subjected to additional processing (such as hydrotreatment, aromatic saturation, ring opening, catalytic dewaxing, or a combination thereof), vehicle tailpipe $NO_x$ emissions (in terms of mg $NO_x$ per km traveled) can be reduced by about 2% to 19% relative to a conventional diesel fuel or a blend of conventional diesel fuel and biodiesel. For example, tailpipe $NO_x$ emissions can be reduced by about 2% to 15%, or about 2 to 10%, or about 2% to 5%. Additionally or alternately, the vehicle tailpipe NOx emissions can be reduced relative to the emissions for a fuel having an aromatics content of 25 wt % or greater.

In some aspects, by operating a diesel vehicle using a diesel fuel with a high naphthene to aromatics ratio and low but substantial aromatics content, and which was subjected to additional processing (such as hydrotreatment, aromatic saturation, ring opening, catalytic dewaxing, or a combination thereof), vehicle engine-out $NO_x$ emissions (in terms of mg $NO_x$ per km traveled) can be reduced by about 2% to 21% relative to a conventional diesel fuel or a blend of conventional diesel fuel and biodiesel. For example, engine-out $NO_x$ emissions can be reduced by about 2% to 15%, or about 2 to 12%, or about 2% to 10%. Additionally or alternately, the engine-out NOx emissions can be reduced relative to the emissions for a fuel having an aromatics content of 25 wt % or greater.

Additional Embodiments

Embodiment 1. A distillate boiling range composition comprising a T90 distillation point of 360° C. or less, a cetane index of 45 or more, a naphthenes to aromatics weight ratio of 2.5 or more, an aromatics content of 4.5 wt % to 25 wt %, a sulfur content of 1000 wppm or less, and a weight ratio of aliphatic sulfur to total sulfur of 0.15 or more, the distillate boiling range composition optionally comprising a ratio of cetane index to weight percent of aromatics of 2.8 or higher.

Embodiment 2. The distillate boiling range composition of Embodiment 1, wherein the distillate boiling range composition comprises a naphthenes to aromatics ratio of 2.6 or more, an aromatics content of 5.0 wt % to 18 wt %, and a sulfur content of 500 wppm or less.

Embodiment 3. The distillate boiling range composition of any of the above embodiments, wherein the distillate boiling range composition comprises a sulfur content of 500 wppm or less, or wherein the density at 15.6° C. is 870 $kg/m^3$ or less, or wherein the saturates content is 78 wt % or more, or wherein the distillate boiling range composition comprises a weight ratio of basic nitrogen to total nitrogen of 0.15 or more, or wherein the cetane index is 55 or more, or a combination thereof.

Embodiment 4. The distillate boiling range composition of any of the above embodiments, wherein the aromatics content is 4.5 wt % to 18 wt %, or wherein the saturates content is 82 wt % or more, or wherein the sulfur content is 500 wppm or less, or wherein the density at 15.6° C. is 835 $kg/m^3$ or less, or a combination thereof.

Embodiment 5. A diesel boiling range composition comprising a T90 distillation point of 375° C. or less, a naphthenes to aromatics weight ratio of 2.5 or more, an aromatics content of 4.5 wt % to 18 wt %, a cetane index of 55 or more, and a sulfur content of 10 wppm or less.

Embodiment 6. The diesel boiling range composition of Embodiment 5, a) wherein the aromatics content is 4.5 wt % to 10 wt %, the naphthenes to aromatics weight ratio is 4.0 or more, and the cetane index is 57 or more, the naphthenes content optionally being 40 wt % or more; or b) wherein the aromatics content is 4.5 wt % to 10 wt %, the naphthenes content is 20 wt % to 35 wt %, and the cetane index is 57 or more.

Embodiment 7. A diesel boiling range composition comprising a T10 distillation point of 250° C. or more, a T90 distillation point of 375° C. or less, a naphthenes to aromatics weight ratio of 1.6 or more, an aromatics content of 4.5 wt % to 25 wt %, a cetane index of 55 or more, and a sulfur content of 10 wppm or less.

Embodiment 8. The diesel boiling range composition of Embodiment 7, wherein the aromatics content is 4.5 wt % to 10 wt %, the naphthenes to aromatics weight ratio is 4.0 or more, and the cetane index is 65 or more.

Embodiment 9. The distillate boiling range composition or diesel boiling range composition of any of Embodiments 1 to 8, wherein the diesel boiling range composition comprises a ratio of cetane index to weight percent of aromatics of 2.8 or higher, or wherein the diesel boiling range composition comprises a volumetric energy density of 36.1 MJ/liter or higher or a combination thereof.

Embodiment 10. Use of a composition comprising a distillate boiling range composition or a diesel boiling range composition according to any of Embodiments 1-9 as a fuel in an engine, a furnace, a burner, a combustion device, or a combination thereof, the composition optionally comprising a carbon intensity of 90 g $CO_2$eq/MJ of lower heating value or less.

Embodiment 11. The use of a composition according to Embodiment 10, wherein the use of the composition is in an engine of a vehicle, wherein i) a fuel consumption for the engine being reduced relative to a fuel having an aromatics content of 25 wt % or more and being reduced relative to a fuel having an aromatics content of 3.0 wt % or less, or ii) wherein the use of the composition is in an engine of a vehicle, a tailpipe emission of at least one of $NO_x$, $CO_2$, CO, and hydrocarbons for the engine being reduced relative to a fuel having an aromatics content of 25 wt % or more, or iii) a combination of i) and ii).

Embodiment 12. A method for forming a diesel boiling range composition, comprising: fractionating a crude oil comprising a final boiling point of 550° C. or more to form at least a diesel boiling range fraction, the crude oil comprising a naphthenes to aromatics volume ratio of 1.6 or more and a sulfur content of 0.2 wt % or less, the diesel boiling range fraction comprising a T90 distillation point of 375° C. or less; and hydrotreating the diesel boiling range fraction to form a hydrotreated diesel boiling range fraction comprising a naphthenes to aromatics weight ratio of 1.6 or more, an aromatics content of 4.5 wt % to 22 wt %, a cetane index of 55 or more, and a sulfur content of 10 wppm or less.

Embodiment 13. The method of Embodiment 12, wherein the diesel boiling range fraction comprises a sulfur content of 40 wppm to 500 wppm prior to the hydrotreating; or wherein the diesel boiling range fraction is hydrotreated prior to the fractionating, the fractionating comprising forming at least the hydrotreated diesel boiling range fraction; or wherein the hydrotreated diesel boiling range fraction comprises a carbon intensity of 90 g $CO_2$eq/MJ of lower heating value or less; or a combination thereof.

Embodiment 14. The method of Embodiment 12 or 13, further comprising exposing the hydrotreated diesel boiling range fraction to aromatic saturation conditions to form an aromatic saturated, hydrotreated diesel boiling range fraction comprising an aromatics content of 4.5 wt % to 10 wt %, a naphthenes to aromatics weight ratio is 4.0 or more, and a cetane index of 57 or more, the aromatic saturated, hydrotreated diesel boiling range fraction optionally comprising a naphthenes content of 40 wt % or more.

Embodiment 15. The method of any of Embodiments 12-14, I) wherein the hydrotreated diesel boiling range fraction comprises an aromatics content of 4.5 wt % to 10 wt %, a naphthenes to aromatics weight ratio is 2.4 or more, a naphthenes content of 20 wt % to 35 wt %, and a cetane index is 57 or more, or 11) wherein the hydrotreated diesel boiling range fraction comprises an aromatics content of 4.5 wt % to 18 wt %, or wherein the hydrotreated diesel boiling range fraction comprises a naphthenes to aromatics weight ratio of 2.8 or more, or a combination thereof.

Additional Embodiment A. The method of any of Embodiments 12-15, further comprising blending at least a portion of the diesel boiling range fraction with a renewable distillate fraction.

Additional Embodiment B. The distillate boiling range composition of any of Embodiments 1-4, wherein distillate boiling range composition comprises a T10 distillation point of 180° C. or more, or wherein the T90 distillation point is 320° C. or less, or a combination thereof.

Additional Embodiment C. A fuel composition comprising a renewable distillate fraction and 5 vol % to 95 vol % of a distillate boiling range composition, the distillate boiling range composition comprising a T90 distillation point of 360° C. or less, a cetane index of 45 or more, a naphthenes to aromatics weight ratio of 2.5 or more, an aromatics content of 4.5 wt % to 25 wt %, a sulfur content of 1000 wppm or less, and a weight ratio of aliphatic sulfur to total sulfur of 0.15 or more.

Additional Embodiment D. The diesel boiling range composition of any of Embodiments 8-10, wherein the aromatics content is 5.0 wt % to 25 wt %.

Additional Embodiment E. The diesel boiling range composition of any of Embodiments 9-10, wherein the aromatics content is 4.5 wt % to 10 wt %, the naphthenes to aromatics weight ratio is 1.8 to 2.5, and the cetane index is 80 or more.

Additional Embodiment F. A method for forming a distillate boiling range composition, comprising: fractionating a crude oil comprising a final boiling point of 550° C. or more to form at least a distillate boiling range fraction, the crude oil comprising a naphthenes to aromatics volume ratio of 1.6 or more and a sulfur content of 0.2 wt % or less, the distillate boiling range fraction comprising a T90 distillation point of 360° C. or less, a cetane index of 45 or more, a naphthenes to aromatics weight ratio of 2.5 or more, an aromatics content of 4.5 wt % to 18 wt %, and a sulfur content of 500 wppm or less.

Additional Embodiment F2. The method of Embodiment F1, further comprising blending at least a portion of the diesel boiling range fraction with a renewable distillate fraction.

Additional Embodiment F3. The method of Additional Embodiment F or F2, wherein the distillate boiling range composition comprises a carbon intensity of 88 g $CO_2$eq/MJ of lower heating value or less.

Additional Embodiment G. The method of Embodiment 12, further comprising exposing the hydrotreated diesel boiling range fraction to aromatic saturation conditions to form an aromatic saturated, hydrotreated diesel boiling range fraction comprising an aromatics content of 4.5 wt % to 10 wt %, a naphthenes to aromatics weight ratio is 4.0 or more, and a cetane index is 65 or more.

Additional Embodiment G2. The method of Additional Embodiment G, wherein the hydrotreated diesel boiling range fraction comprises an aromatics content of 4.5 wt % to 10 wt %, a naphthenes to aromatics weight ratio of 1.8 to 2.5, and a cetane index of 80 or more.

Additional Embodiment H. The diesel boiling range composition of Embodiment 5, wherein the aromatics content is 4.5 wt % to 16 wt %, or wherein the naphthenes to aromatics weight ratio is 2.9 or more, or a combination thereof.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

What is claimed is:

1. A distillate boiling range composition comprising a T90 distillation point of 360° C. or less, a cetane index of 45 or more, a naphthenes to aromatics weight ratio of 2.5 or more, an aromatics content of 4.5 wt % to 25 wt %, a sulfur content of 1000 wppm or less, and a weight ratio of aliphatic sulfur to total sulfur of 0.15 or more, and wherein the distillate boiling range composition has not been exposed to hydroprocessing conditions.

2. The distillate boiling range composition of claim 1, wherein the distillate boiling range composition comprises a naphthenes to aromatics ratio of 2.6 or more, an aromatics content of 5.0 wt % to 18 wt %, and a sulfur content of 500 wppm or less.

3. The distillate boiling range composition of claim 1, wherein the distillate boiling range composition comprises a sulfur content of 500 wppm or less, or wherein the density at 15.6° C. is 870 kg/$m^3$ or less, or wherein the saturates content is 78 wt % or more, or wherein the distillate boiling range composition comprises a weight ratio of basic nitrogen to total nitrogen of 0.15 or more, or wherein the cetane index is 55 or more, or a combination thereof.

4. The distillate boiling range composition of claim 1, wherein the aromatics content is 4.5 wt % to 18 wt %, or wherein the saturates content is 82 wt % or more, or wherein the sulfur content is 500 wppm or less, or wherein the density at 15.6° C. is 835 kg/$m^3$ or less, or a combination thereof.

5. The distillate boiling range composition of claim 1, wherein the distillate boiling range composition comprises a ratio of cetane index to weight percent of aromatics of 2.8 or higher.

6. The distillate boiling range composition of claim 1, wherein the distillate boiling range composition is used as a fuel in an engine, a furnace, a burner, a combustion device, or a combination thereof.

7. The distillate boiling range composition of claim 1, wherein the distillate boiling range composition comprises a carbon intensity of 88 g $CO_2$eq/MJ of lower heating value or less.

8. A diesel boiling range composition comprising a T90 distillation point of 375° C. or less, a naphthenes to aromatics weight ratio of 2.5 or more, an aromatics content of 4.5 wt % to 18 wt %, a cetane index of 55 or more, a density at 15° C. of 810 to 835 kg/$m^3$, and a sulfur content of 10 wppm or less.

9. The diesel boiling range composition of claim 8, wherein the aromatics content is 4.5 wt % to 16 wt %, or wherein the naphthenes to aromatics weight ratio is 2.9 or more, or a combination thereof.

10. The diesel boiling range composition of claim 8, wherein the aromatics content is 4.5 wt % to 10 wt %, the naphthenes to aromatics weight ratio is 4.0 or more, and the cetane index is 57 or more.

11. The diesel boiling range composition of claim 10, wherein the naphthenes content is 40 wt % or more.

12. The diesel boiling range composition of claim 8, wherein the aromatics content is 4.5 wt % to 10 wt %, the naphthenes content is 20 wt % to 35 wt %, and the cetane index is 57 or more.

13. The diesel boiling range composition of claim 8, wherein the diesel boiling range composition comprises a ratio of cetane index to weight percent of aromatics of 2.8 or higher, or wherein the diesel boiling range composition comprises a volumetric energy density of 36.1 MJ/liter or higher or a combination thereof.

14. The diesel boiling range composition of claim 1, wherein the diesel boiling range composition is used as a fuel in an engine, a furnace, a burner, a combustion device, or a combination thereof, the diesel boiling range composition optionally comprising a carbon intensity of 90 g $CO_2$eq/MJ of lower heating value or less.

15. The diesel boiling range composition of claim 14, wherein the diesel boiling range composition is used in an engine of a vehicle, a tailpipe emission of at least one of NOx, $CO_2$, CO, and hydrocarbons for the engine being reduced relative to a fuel having an aromatics content of 25 wt % or more.

16. The diesel boiling range composition of claim 14, wherein the diesel boiling range composition is used in an engine of a vehicle, a fuel consumption for the engine being reduced relative to a fuel having an aromatics content of 25 wt % or more and being reduced relative to a fuel having an aromatics content of 3.0 wt % or less.

17. A diesel boiling range composition comprising a T10 distillation point of 250° C. or more, a T90 distillation point of 375° C. or less, a naphthenes to aromatics weight ratio of 1.6 or more, an aromatics content of 4.5 wt % to 25 wt %, a cetane index of 55 or more, a density at 15° C. of 810 to 835 kg/m$^3$, and a sulfur content of 10 wppm or less.

18. The diesel boiling range composition of claim 17, wherein the aromatics content is 4.5 wt % to 10 wt %, the naphthenes to aromatics weight ratio is 4.0 or more, and the cetane index is 65 or more.

19. The diesel boiling range composition of claim 17, wherein the aromatics content is 5.0 wt % to 25 wt %.

20. The diesel boiling range composition of claim 17, wherein the diesel boiling range composition comprises a ratio of cetane index to weight percent of aromatics of 2.8 or higher, or wherein the diesel boiling range composition comprises a volumetric energy density of 36.1 MJ/liter or higher or a combination thereof.

21. A method for forming a diesel boiling range composition, comprising:

fractionating a crude oil comprising a final boiling point of 550° C. or more to form at least a diesel boiling range fraction, the crude oil comprising a naphthenes to aromatics volume ratio of 1.6 or more and a sulfur content of 0.2 wt % or less, the diesel boiling range fraction comprising a T90 distillation point of 375° C. or less; and hydrotreating the diesel boiling range fraction to form a hydrotreated diesel boiling range fraction comprising a naphthenes to aromatics weight ratio of 1.6 or more, an aromatics content of 4.5 wt % to 22 wt %, a cetane index of 55 or more, a density at 15° C. of 810 to 835 kg/m$^3$, and a sulfur content of 10 wppm or less.

22. The method of claim 21, wherein the diesel boiling range fraction comprises a sulfur content of 40 wppm to 500 wppm prior to the hydrotreating; or wherein the diesel boiling range fraction is hydrotreated prior to the fractionating, the fractionating comprising forming at least the hydrotreated diesel boiling range fraction; or wherein the hydrotreated diesel boiling range fraction comprises a carbon intensity of 90 g $CO_2$eq/MJ of lower heating value or less; or a combination thereof.

23. The method of claim 21, wherein the hydrotreated diesel boiling range fraction comprises an aromatics content of 4.5 wt % to 18 wt %, or wherein the hydrotreated diesel boiling range fraction comprises a naphthenes to aromatics weight ratio of 2.8 or more, or a combination thereof.

24. The method of claim 21, further comprising exposing the hydrotreated diesel boiling range fraction to aromatic saturation conditions to form an aromatic saturated, hydrotreated diesel boiling range fraction comprising an aromatics content of 4.5 wt % to 10 wt %, a naphthenes to aromatics weight ratio is 4.0 or more, and a cetane index of 57 or more, the aromatic saturated, hydrotreated diesel boiling range fraction optionally comprising a naphthenes content of 40 wt % or more.

25. The method of claim 21, wherein the hydrotreated diesel boiling range fraction comprises an aromatics content is 4.5 wt % to 10 wt %, a naphthenes to aromatics weight ratio is 2.4 or more, a naphthenes content of 20 wt % to 35 wt %, and a cetane index is 57 or more.

26. The method of claim 21, further comprising blending at least a portion of the diesel boiling range fraction with a renewable distillate fraction.

* * * * *